US009167656B2

(12) United States Patent
Raj et al.

(10) Patent No.: US 9,167,656 B2
(45) Date of Patent: Oct. 20, 2015

(54) LIFETIME CORRECTION FOR AGING OF LEDS IN TUNABLE-WHITE LED LIGHTING DEVICES

(71) Applicant: ABL IP HOLDING LLC, CONYERS, GA (US)

(72) Inventors: Rashmi K. Raj, Herndon, VA (US); Jason W. Rogers, Herndon, VA (US)

(73) Assignee: ABL IP HOLDING LLC, Conyers, GA (US)

( * ) Notice: Subject to any disclaimer, the term of this patent is extended or adjusted under 35 U.S.C. 154(b) by 0 days.

(21) Appl. No.: 13/972,309

(22) Filed: Aug. 21, 2013

(65) Prior Publication Data

US 2014/0035465 A1 Feb. 6, 2014

Related U.S. Application Data

(63) Continuation-in-part of application No. 13/464,480, filed on May 4, 2012, now Pat. No. 8,710,768.

(51) Int. Cl.

| | |
|---|---|
| ***H05B 33/08*** | (2006.01) |
| ***G09G 3/30*** | (2006.01) |
| ***G09G 3/32*** | (2006.01) |

(52) U.S. Cl.

CPC ..... *H05B 33/0869* (2013.01); *G09G 3/30* (2013.01); *G09G 3/32* (2013.01); *H05B 33/086* (2013.01); *H05B 33/0863* (2013.01)

(58) Field of Classification Search

CPC ..... H05B 33/0869; H05B 33/0863; H05B 33/083; H05B 33/086; H05B 33/0857; H05B 37/02; G01J 3/46; G01J 3/462; G01J 1/32; G01J 3/505; G01J 3/501; G01J 3/524; G09G 3/30; G09G 3/32

USPC ..... 315/151–153, 291, 294, 297, 209 R, 315/307, 308, 318, 185 R

See application file for complete search history.

(56) References Cited

U.S. PATENT DOCUMENTS

| | | | |
|---|---|---|---|
| 6,127,783 | A | 10/2000 | Pashley et al. |
| 6,149,283 | A | 11/2000 | Conway et al. |

(Continued)

FOREIGN PATENT DOCUMENTS

| | | | |
|---|---|---|---|
| WO | WO 2009/035493 | A1 | 3/2009 |
| WO | WO 2011/024101 | A1 | 3/2011 |

OTHER PUBLICATIONS

Arnold Wilkins et al., "LED Lighting Flicker and Potential Health Concerns: IEEE Standard PAR1789 Update."

(Continued)

*Primary Examiner* — Vibol Tan

(74) *Attorney, Agent, or Firm* — RatnerPrestia

(57) ABSTRACT

A lighting system having at least three light sources receives an input relating to color coordinates of a target point representing a desired color characteristic for a combined output from the light sources. The system provides color tunable output and/or dimmable output in response to differences in user input. The system also corrects changes in performance of the light sources due to lifetime degradation in each of the light sources. After a period of system operation, outputs of the sources are measured. The system increases the luminosity outputs of each of the light sources by a respective amount relative to the degradations measured in all the light sources; in this manner, the luminosity outputs of the light sources remain substantially constant in relations to each other over the lifetime of the light sources.

20 Claims, 29 Drawing Sheets

(56) References Cited

U.S. PATENT DOCUMENTS

| | | | | |
|---|---|---|---|---|
| 6,411,046 | B1 | 6/2002 | Muthu | |
| 6,441,558 | B1 | 8/2002 | Muthu et al. | |
| 6,495,964 | B1 | 12/2002 | Muthu et al. | |
| 6,636,003 | B2 | 10/2003 | Rahm et al. | |
| 6,969,843 | B1 | 11/2005 | Beach et al. | |
| 7,145,125 | B2 | 12/2006 | May et al. | |
| 7,148,632 | B2 | 12/2006 | Berman et al. | |
| 7,478,922 | B2 | 1/2009 | Garbus | |
| 7,497,590 | B2 | 3/2009 | Rains, Jr. et al. | |
| 7,560,677 | B2 | 7/2009 | Lyons et al. | |
| 7,626,345 | B2 | 12/2009 | Young | |
| 7,709,774 | B2 * | 5/2010 | Schulz et al. | 250/205 |
| 7,768,192 | B2 | 8/2010 | Van De Ven et al. | |
| 7,821,212 | B2 | 10/2010 | Wray | |
| 7,959,321 | B2 | 6/2011 | Ryu et al. | |
| 7,986,102 | B2 * | 7/2011 | Roberts | 315/209 R |
| 8,232,736 | B2 | 7/2012 | Melanson | |
| 8,264,168 | B2 | 9/2012 | Feri et al. | |
| 8,294,074 | B2 | 10/2012 | Lyons et al. | |
| 8,363,069 | B2 | 1/2013 | Aldrich et al. | |
| 8,564,205 | B2 * | 10/2013 | Roberts et al. | 315/82 |
| 8,710,768 | B2 * | 4/2014 | Rogers et al. | 315/297 |
| 8,760,074 | B2 * | 6/2014 | Raj et al. | 315/291 |
| 2005/0225976 | A1 | 10/2005 | Zampini et al. | |
| 2006/0049782 | A1 | 3/2006 | Vornsand et al. | |
| 2006/0237636 | A1 | 10/2006 | Lyons et al. | |
| 2006/0268544 | A1 | 11/2006 | Rains, Jr. et al. | |
| 2007/0045524 | A1 | 3/2007 | Rains et al. | |
| 2007/0182682 | A1 | 8/2007 | Hong et al. | |
| 2008/0205053 | A1 | 8/2008 | Rains, Jr. et al. | |
| 2010/0102756 | A1 | 4/2010 | Shin et al. | |
| 2010/0244701 | A1 | 9/2010 | Chen et al. | |
| 2010/0259917 | A1 | 10/2010 | Ramer et al. | |
| 2010/0301777 | A1 | 12/2010 | Kraemer | |
| 2011/0018465 | A1 * | 1/2011 | Ashdown | 315/294 |
| 2011/0175546 | A1 | 7/2011 | Ramer et al. | |
| 2011/0181199 | A1 | 7/2011 | Lin et al. | |
| 2012/0013255 | A1 | 1/2012 | Young | |
| 2012/0038287 | A1 | 2/2012 | Li et al. | |
| 2013/0049602 | A1 | 2/2013 | Raj et al. | |
| 2014/0103812 | A1 * | 4/2014 | Roberts et al. | 315/151 |

OTHER PUBLICATIONS

Philippe Colantoni et al., "Color Space Transformations," 2004.

International Search Report and Written Opinion Issued in International Application No. PCT/US2013/037961, Dated Aug. 20, 2013.

International Search Report and the Written Opinion of the International Searching Authority issued in International Application No. PCT/US2012/051085, mailed Nov. 2, 2012.

Entire prosecution history of U.S. Appl. No. 13/464,480, filed May 4, 2012, entitled "Algorithm for Color Corrected Analog Dimming in Multi-Color LED System."

* cited by examiner

LIFETIME CORRECTION FOR AGING OF LEDS IN TUNABLE-WHITE LED LIGHTING DEVICES

CROSS REFERENCE TO RELATED APPLICATIONS

This application is a continuation-in-part of U.S. patent application Ser. No. 13/464,480, filed May 4, 2012, entitled, "ALGORITHM FOR COLOR CORRECTED ANALOG DIMMING IN MULTI-COLOR LED SYSTEM." The entire contents of that application is expressly incorporated herein by reference.

TECHNICAL FIELD

The present subject matter generally relates to techniques and equipment for color correction of a dimmed light produced by a system that combines light from multiple color sources. Disclosed examples provide color correction in a multi-color lighting system to produce a color corrected output light having a color characteristic corresponding to a target color point when a light of the target color point is dimmed to a proportion of a maximum intensity. In addition, the present subject matter includes techniques and equipment for correcting changes in performance of light emitting diodes (LEDs) in multi-color lighting systems, due to degradations in light output over time during the LEDs' lifetime.

BACKGROUND

An increasing variety of lighting applications utilize electronic type emitters as light sources. Examples of such emitters include solid state light sources, such as light emitting diodes (LEDs) and organic light emitting diodes (OLEDs) as well as plasma type light emitters. An LED produces light output, when a voltage across two terminals thereof (e.g., anode and cathode) exceeds the LED's forward voltage so that forward current can flow through the LED. The intensity of light output from the LED is primarily governed by the amount of forward current flowing through the LED. In order to dim a light emitted from the LED, the forward current flowing through the LED needs to be manipulated. There are two commonly used methods for dimming lights from LEDs. One is Pulse Width Modulation (PWM) Dimming, and the other is Analog Dimming. Both methods result in changing the average current through the LEDs and hence provide a visual appearance of changing intensities of light output from the LEDs. FIG. 1 illustrates an example of an LED's relative luminous flux characteristic, i.e., a relationship between forward current and relative luminous flux. FIG. 2 illustrates an example of an LEDs power consumption by depicting a relationship between forward current and forward voltage.

There is an industry-wide consensus that Analog Dimming may be superior to PWM Dimming. However, Analog Dimming has a drawback of undesirable color variation. In a given LED, if the peak current is varied, the current density (or J) also varies. More particularly, in a Gallium Nitride (GaN) based LED system (for example, Blue and Green type LEDs), a varying current density may lead to not only a varying intensity output but also a varying chromaticity output. In other words, in GaN based materials, Analog Dimming may lead to both intensity and chromaticity variations. While the intensity variation is a desirable effect of dimming, the associated chromaticity variation may not be a desirable one. For example, referring to the graph in FIG. 3, with Analog Dimming in Green LEDs, the chromaticity ((x, y)-coordinates of five connected dots in FIG. 3) shifts due to different forward currents of the LEDs used to produce light (at the five connected dots in FIG. 3). Moreover, as shown in FIG. 4, this shift in chromaticity results in changing dominant wavelength. Hence a need exists for techniques and equipment for color correction of a light emitted from a lighting system to correct for a color change with Analog Dimming of the light.

Furthermore, almost all LEDs show degradations in light output over time during the LEDs' lifetime. FIG. 5 illustrates an example of an LED's lifetime degradation characteristic (i.e., hours used vs. light output). More particularly, FIG. 5 shows that light output of the LED has degraded by 14 percent after ten thousand hours. Hence, when Analog Dimming current density correction is applied, there is still room for further improvement in correcting for changes in color or lumen output of LEDs, either due to temperature changes of the lighting system or due to the LEDs' lifetime degradation.

SUMMARY

The teachings herein alleviate one or more of the above noted problems and provide improvements in color corrected lighting systems, for example, in a system that combines light from multiple color sources to produce light of a desired color characteristic. Both methods and systems are discussed.

For example, a lighting system may include at least three light sources each for producing light of a different one of at least three colors, each light source including one or more light emitting diodes (LEDs); an input; a photosensor; and a controller responsive to information received via the input and coupled to control the at least three light sources to produce a combined light output of the system. The controller is configured to control functions of the lighting system, including functions to: for a period of operation of the lighting system, selectively control drive currents supplied to the LEDs of the at least three light sources to produce combined light output of an overall color characteristic corresponding to a user input selection, based in part on determined output characteristics of the LEDs of the at least three light sources. After the period of operation of the lighting system, obtain updated output characteristics of the LEDs of the at least three light sources including functions to: (a) drive one or more LEDs configured for producing light of a first of the at least three color characteristics, while LEDs configured for producing light other than the first color characteristic are turned OFF, and measure a level of the light of the first color characteristic with the photosensor; (b) drive one or more LEDs configured for producing light of a second of the at least three color characteristics, while LEDs configured for producing light other than the second color characteristic are turned OFF, and measure a level of the light of the second color characteristic with the photosensor; (c) drive one or more LEDs configured for producing light of a third of the at least three color characteristics, while LEDs configured for producing light other than the third color characteristic are turned OFF, and measure a level of the light of the third color characteristic with the photosensor; (d) process the measured levels of the light of the first, second and third color characteristics to obtain the updated output characteristics of the LEDs of the at least three light sources; and (e) selectively control drive currents supplied to the LEDs of the three light sources to produce a combined light output of an overall color characteristic corresponding to a user input selection, based in part on the updated output characteristics of the LEDs of the three light sources.

The controller is configured to control further functions of the lighting system, including functions to: (f) determine a relative amount of change in each of the three levels of light, after the period of operation, in which the relative amount of change is measured between (i) an initial time during the period of operation and (ii) a final time after the period of operation; (g) determine the smallest relative amount of change among the first, second, and third color characteristics; and (h) increase the drive current supplied to the one or more LEDs configured for producing a respective first, second, or third color characteristic by the difference between (i) the smallest relative amount of change and (ii) the relative amount of change determined in the respective first, second, or third color characteristic.

The controller is also configured to control further functions of the lighting system, including functions to: determine each of the three levels of light, at an initial time during the period of operation; determine a respective amount of change for each of the three levels of light, at a final time after the period of operation; and increase the drive current supplied to the one or more LEDs configured for producing a respective first, second, or third color characteristic by the respective amount of change.

The lighting system further includes: a first set of multiple LEDs and a second set of multiple LEDs connected in series for producing, respectively, the light of the first and second color characteristics, and a first switch for electrically shorting the first set of multiple LEDs and a second switch for electrically shorting the second set of multiple LEDs. The controller is configured to drive the first set of LEDs, while the second set of LEDs is electrically shorted, and measure the level of the light of the first color characteristic with the photosensor. The controller is also configured to drive the second set of LEDs, while the first set of LEDs is electrically shorted, and measure the level of the light of the second color characteristic with the photosensor.

The controller is configured to control further functions of the lighting system, including functions to: turn OFF the photosensor, during the period of operation; and turn ON the photosensor, after the period of operation, for measuring the levels of the light with the photosensor.

The lighting system includes information received at the input includes one of the following: a manual command to turn ON the photosensor; and an automatic command from a remote location to turn ON the photosensor.

The controller is configured to provide the following functions on receiving an input from a user relating to color coordinates of a target point defined in a color space: determine first-pass driver currents supplied to the LEDs for the three light sources to achieve spectral characteristics of light at the target point; and determine second-pass driver currents supplied to the LEDs for the three light sources to achieve spectral characteristics of light at the target point. The second-pass driver currents are configured to be closer to the target point than the first-pass driver currents.

Yet another example includes a method for controlling a multi-color lighting system for combining light from multiple solid state light sources of the system, each configured for producing light of a different color characteristic, each light source comprising one or more light emitting diodes (LEDs). The method includes the steps of:

for a period of operation, selectively controlling drive currents supplied to the LEDs of the multiple solid state light sources to produce a combined light output of overall color characteristic and intensity corresponding to a user input selection based in part on determined output characteristics of the LEDs of the multiple solid state light sources;

after the period of operation, obtaining updated output characteristics of the LEDs of the multiple solid state light sources by:

(a) driving one or more LEDs configured for producing light of a first color characteristic, while LEDs configured for producing light of different color characteristics than the first color characteristic are turned OFF, and measuring a level of the light of the first color characteristic with a photosensor;

(b) driving one or more LEDs configured for producing light of a second color characteristic, while LEDs configured for producing light of different color characteristics than the second color characteristic are turned OFF, and measuring a level of the light of the second color characteristic with the photosensor;

(c) driving one or more LEDs configured for producing light of a third color characteristic, while LEDs configured for producing light of different color characteristics than the third color characteristic are turned OFF, and measuring a level of the light of the third color characteristic with the photosensor; and (d) processing the measured levels of the light of the first, second and third color characteristics to obtain updated output characteristics of the LEDs of the multiple solid state light sources; and (e) selectively controlling drive currents supplied to the LEDs of the multiple solid state light sources to produce combined light output of an overall color characteristic corresponding to a user input selection, based in part on the updated determined output characteristics of the LEDs of the multiple solid state light sources.

The step of selectively controlling the drive currents based in part on the updated determined output characteristics includes: correcting changes in performance of the LEDs of the multiple solid state light sources, after the period of operation of the multi-color lighting system.

The step of correcting changes in performance includes: correcting changes in performance due to a lifetime degradation of the LEDs of the multiple solid state light sources.

The step of processing includes:

(a) determining a relative amount of change in each of the three levels of light, after the period of operation, in which the relative amount of change is measured between (i) an initial time during the period of operation and (ii) a final time after the period of operation; and (b) determining the smallest relative amount of change among the first, second and third color characteristics; and (c) the step of selectively controlling the drive currents based in part on the updated determined output characteristics includes:

(d) increasing the drive current supplied to the one or more LEDs configured for producing a respective first, second, or third color characteristic by the difference between (i) the smallest relative amount of change and (ii) the relative amount of change determined in the respective first, second, or third color characteristic.

The processing step includes: determining each of the four levels of light, at an initial time during the period of operation; and determining a respective amount of change for each of the four levels of light, at a final time after the period of operation.

The step of selectively controlling drive currents based in part on the updated determined output characteristics includes: increasing the drive current supplied to the one or more LEDs configured for producing a respective first, second, third, or fourth color characteristic by the respective amount of change.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

Figure 1:
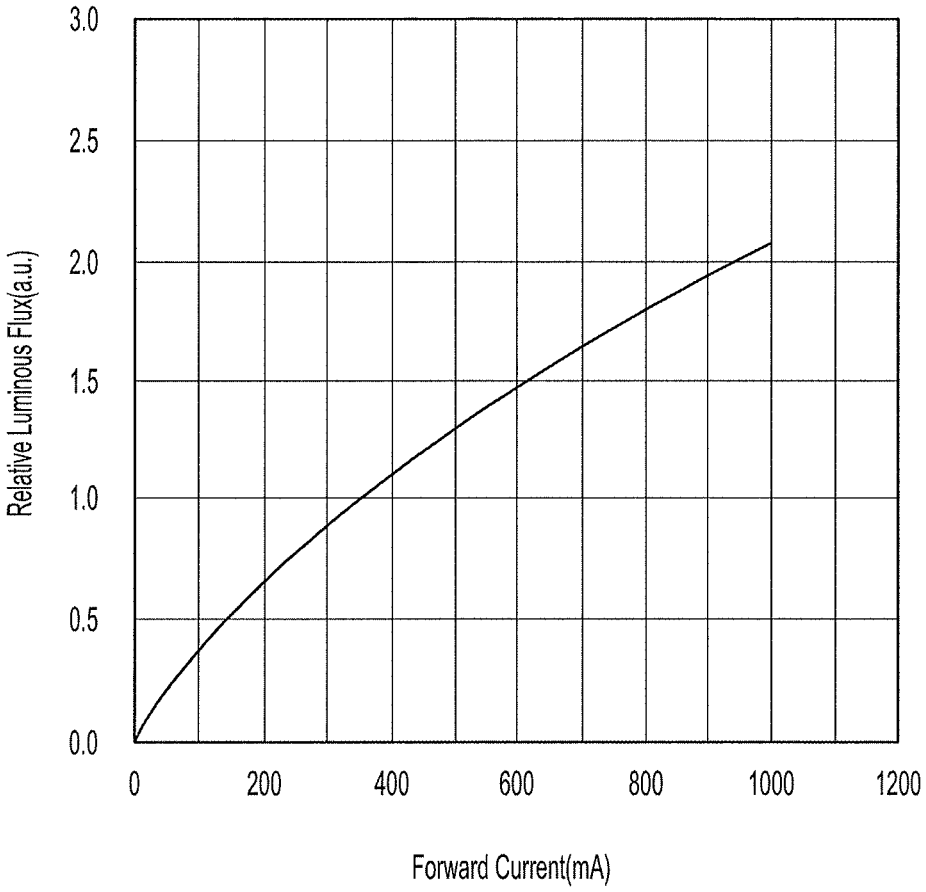
FIG. 1 illustrates an example of an LED's luminous flux characteristic (i.e., forward current vs. relative luminous flux).
Figure 2:
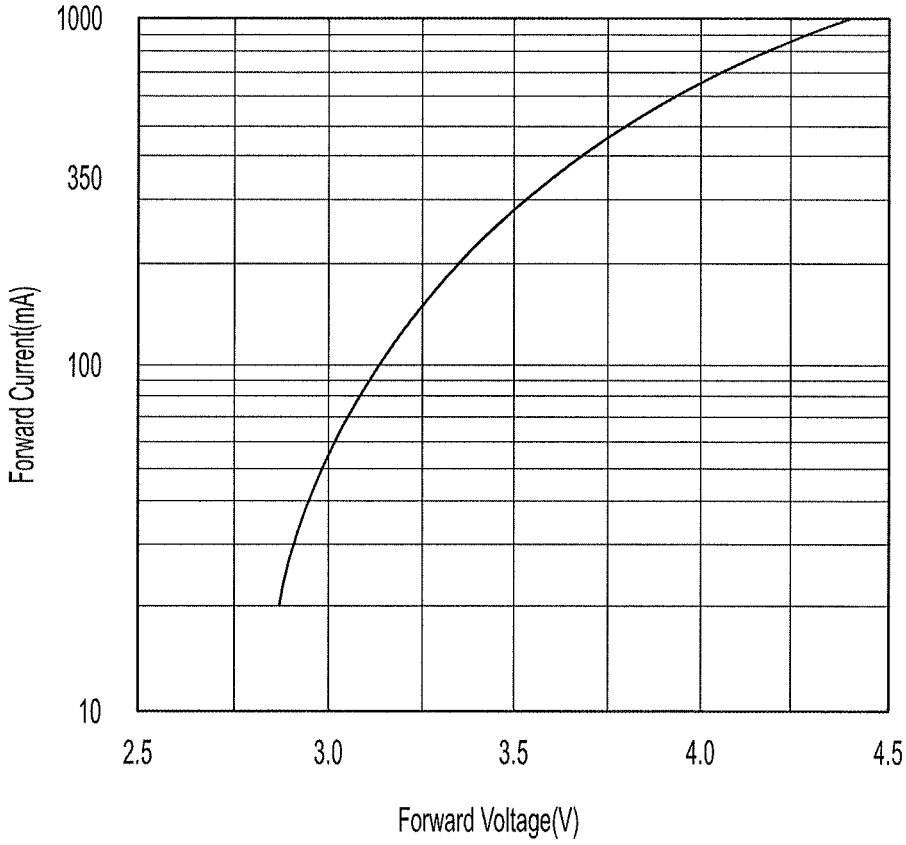
FIG. 2 illustrates an example of an LED's power consumption characteristic (i.e., forward voltage vs. forward current).
Figure 3:
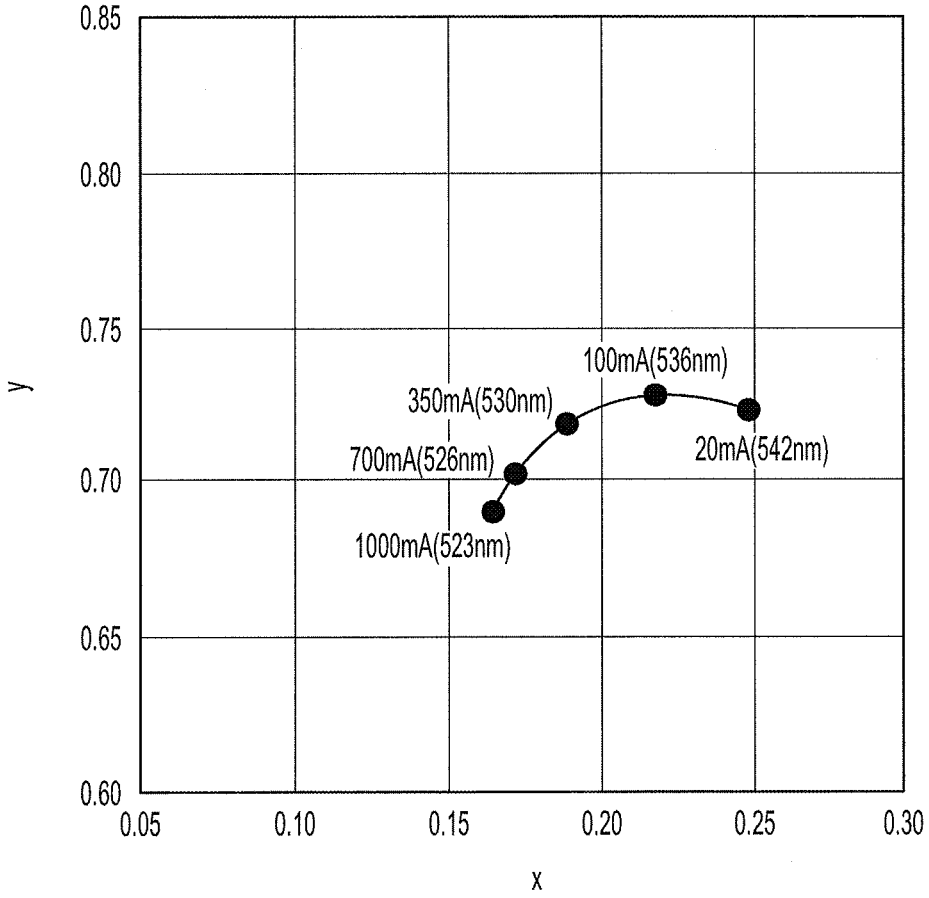
FIG. 3 illustrates an example of an LED's characteristic of chromaticity changes with Analog Dimming (i.e., due to forward current changes).
Figure 4:
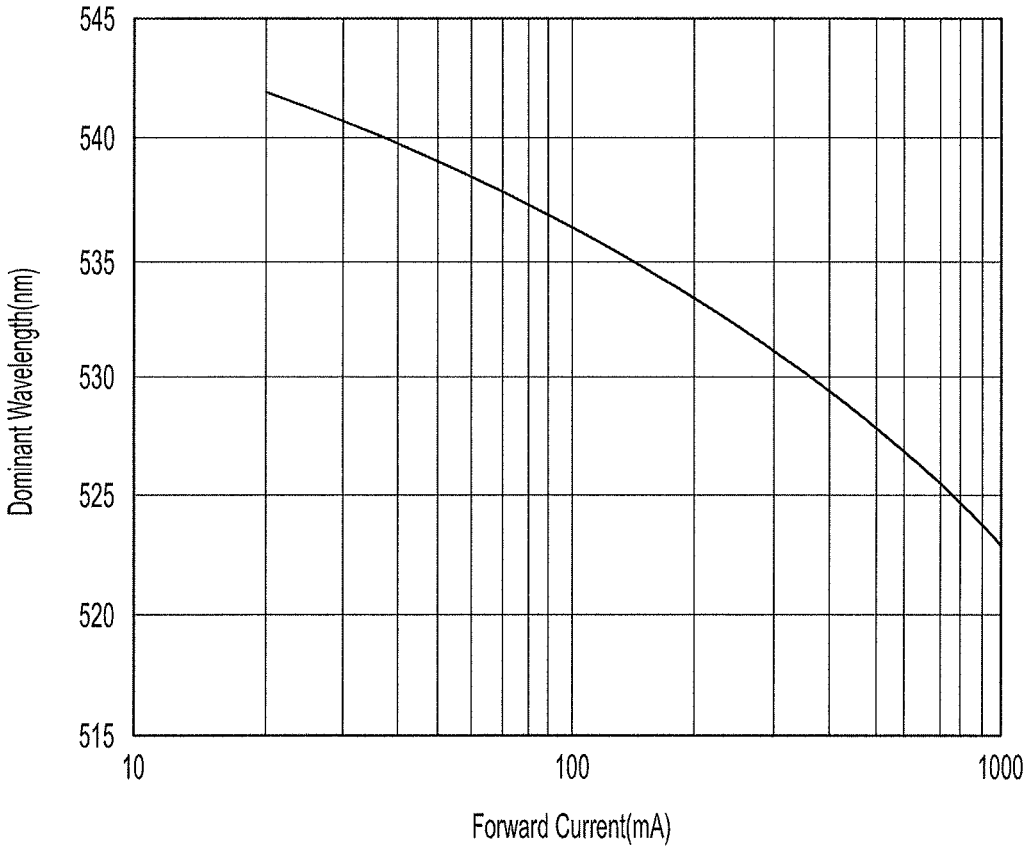
FIG. 4 illustrates an example of an LED's dominant wavelength characteristic (i.e., forward current vs. dominant wavelength).
Figure 5:
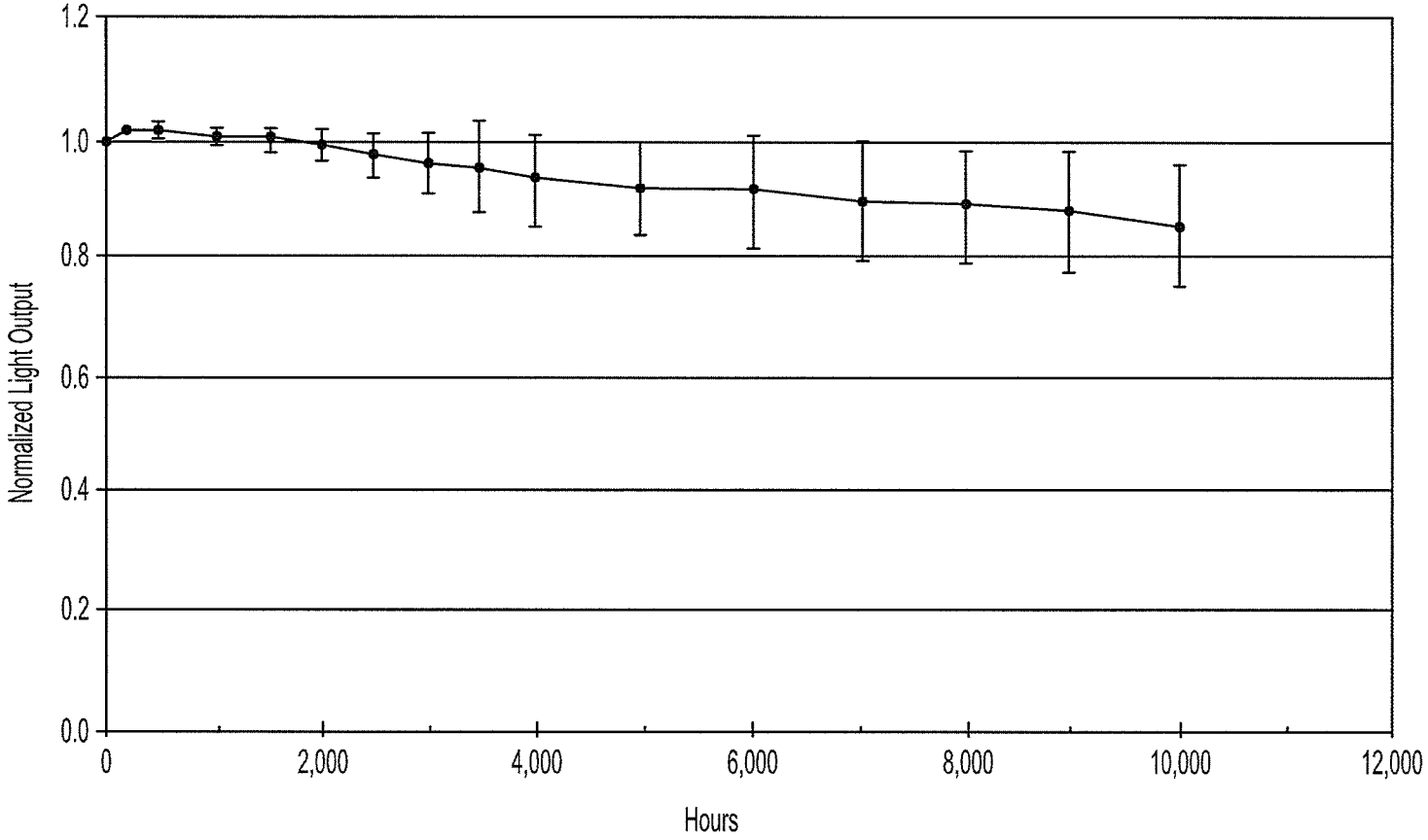
FIG. 5 illustrates an example of an LED's lifetime degradation characteristic (i.e., hours used vs. light output).

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The various examples disclosed in this section relate to systems and methods for controlling a multi-color lighting system, which may use Analog Dimming, to produce a color corrected output light when a light emitted from the lighting system is dimmed to a proportion of a maximum intensity. The system uses sources of different colors of light. Each source includes one or more light emitters. Various types of emitters may be used to construct sources of respective colors of light. For example, the multi-color lighting system may use solid state light sources, such as light emitting diodes (LEDs) and organic light emitting diodes (OLEDs). Alternatively, one or more of the sources may use plasma type emitters. A variety of examples of such arrangements as well as techniques for making and operating such mechanisms, etc., that so produce a color corrected output light, are discussed below.

With systems of this type, a problem arises from long-term use of LEDs or similar types of solid state light sources. As the solid state source elements age, the output intensity for a given input level of the drive current decreases. As a result, it may be necessary to increase power to an LED or the like to maintain a desired output level. However, as performance of the solid state sources of different light colors declines differently with age (e.g. due to differences in structure and/or usage), it may be difficult to maintain desired relative output levels and, therefore, difficult to maintain the desired spectral characteristics of the combined output. Compensation for such aging effects has been handled in various ways. One approach is to use manufacturer's data with respect to degradation of performance over time and adjust the color control algorithm accordingly. This approach, however, may not be accurate in all of the lighting devices using the particular sources, for example, because the manufacturer's data may be typical or average but the LEDs or the like in a particular device may not perform as predicted by the manufacturer's data. Another approach incorporates real time color feedback. This later approach is effective but requires inclusion of a real-time color sensor and associated feedback as an integral aspect of the color control algorithm.

Hence, in some of the examples discussed in detail below, a lighting system that provides color tunable output and/or dimmable output in response to differences in user input also corrects changes in performance of the light sources due to lifetime degradation in each of the light sources. After a period of system operation, outputs of the sources are measured. The system increases the luminosity outputs of each of the light sources by a respective amount relative to the degradations measured in all the light sources; in this manner, the luminosity outputs of the light sources remain substantially constant in relations to each other over the lifetime of the light sources.

Figure 6:
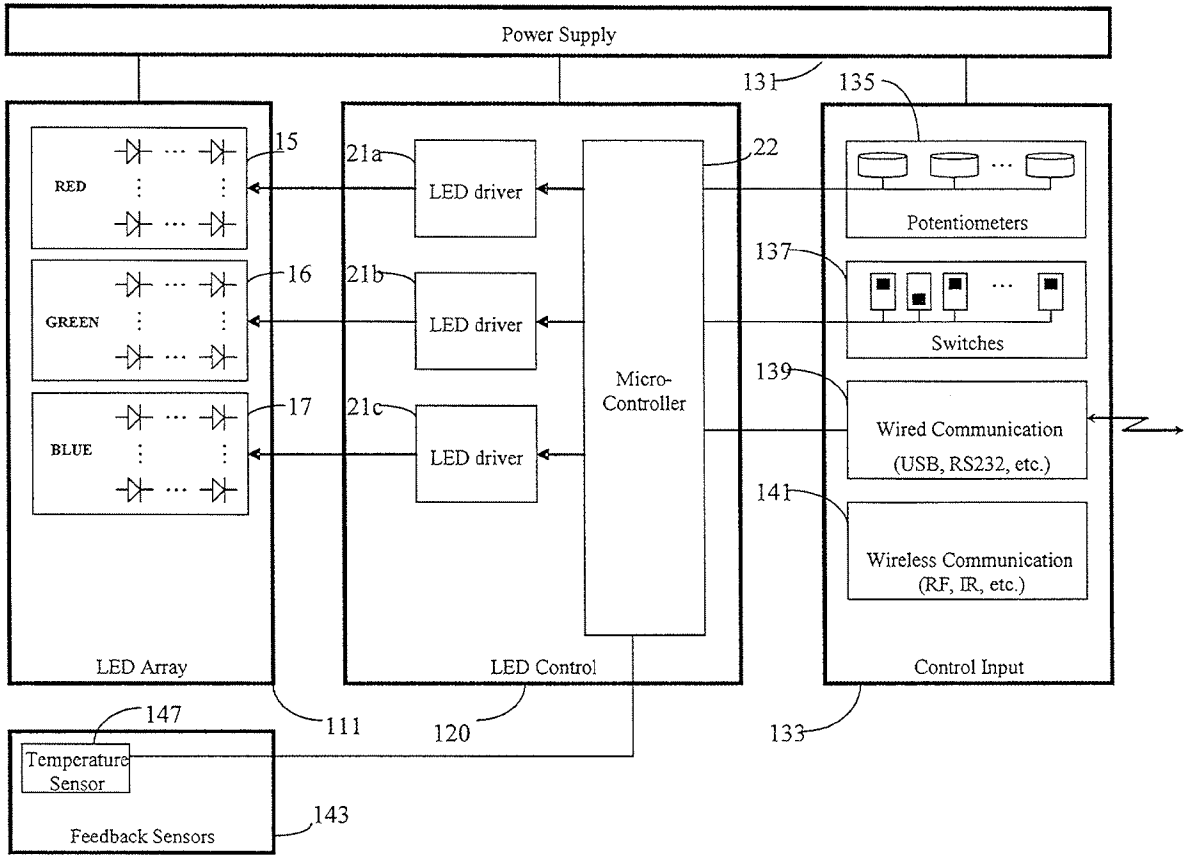
FIG. 6 is a functional block diagram of the electrical components of an example of a light emitting system using programmable digital control logic, where three channels drive three color light sources, i.e., Red LEDs, Green LEDs, and Blue LEDs, respectively.

Reference now is made in detail to the examples illustrated in the accompanying drawings and discussed below. FIG. 6 is a block diagram of an example of an electrical system for light sources and associated control circuit, providing digital programmable control to produce a color corrected output light. In this circuit example, the light sources may take the form of a group of emitter devices within an LED array 111. The array 111 may include at least one Red LED 15 as a source of red light, at least one Green LED 16 as a source of green light, and at least one Blue LED 17 as a source of blue light, although other color LEDs may be used in place of or in addition to those shown (as in FIGS. 7-9). Other light emitter devices may be used as the emitters of the respective color light sources. Examples of the other electronic emitter devices include plasma devices and other solid state devices such as organic LEDs (OLEDs). For discussion and illustration purposes, examples that use one or more LEDs will be referred to as the emitter devices of each respective color light source.

The electrical components shown in FIG. 6 also include an LED control system 120. The system 120 includes driver circuits 21*a*, 21*b* and 21*c* for the various LEDs and a microcontroller 22. The driver circuits 21*a* to 21*c* supply electrical current to respective LEDs 15, 16 and 17 to cause the LEDs to emit light. In the example shown in FIG. 6, the three driver circuits 21*a* to 21*c* drive three color light sources, i.e., the Red LEDs 15, the Green LEDs 16 and the Blue LEDs 17, respectively. The intensity of the emitted light of a given LED is proportional to the level of current supplied by the respective driver circuit, so that the emitted light can be dimmed to a desired proportion of a maximum intensity. Further, the electrical system may also include one or more digital to analog converters (DACs) (not separately shown). In this regard, the microcontroller 22 may control the DACs, which in turn provide signals to the respective drivers 21*a* to 21*c*.

The analog current output level of each of the driver circuits 21*a* to 21*c* may be controlled by a higher level logic of the system. In this digital control example, that logic is implemented by the programmable microcontroller 22, although the logic could take other forms, such as discrete logic components, an application specific integrated circuit (ASIC), etc.

As shown in FIG. 6, the LED driver circuits 21*a* to 21*c* and the microcontroller 22 receive power from a power supply 131, which is connected to an appropriate power source (not separately shown). For most task-lighting applications, for example, the power source will be an AC line current source, however, some applications may utilize DC power from a battery or the like. The power supply 131 converts the voltage and current from the source to the levels needed by the driver circuits 21*a* to 21*c* and the microcontroller 22.

A programmable microcontroller may include or have coupled thereto random-access memory (RAM) for storing data and read-only memory (ROM) and/or electrically erasable read only memory (EEROM) for storing control programming and any pre-defined operational parameters, such as pre-established light 'recipes.' The microcontroller 22 itself includes registers and other components for implementing a central processing unit (CPU) and possibly an associated arithmetic logic unit. The CPU implements the program to process data in the desired manner and thereby generates desired control outputs.

Referring to FIG. 6, the microcontroller 22 is programmed to control the LED driver circuits 21*a* to 21*c* to set the individual output intensities of the LEDs to desired levels, so that the combined light emitted from the LEDs has a desired spectral characteristic and a desired overall intensity. The microcontroller 22 may be programmed to essentially establish and maintain or preset a desired 'recipe' or mixture of the available wavelengths provided by the LEDs. More particularly, the microcontroller 22 receives control inputs specifying the particular 'recipe' or mixture, as will be described below. The input information will include or can be translated to color coordinates of a target point, for a desired color characteristic for the combined output light from the system. The input information may also indicate an overall intensity or dimming level. The microcontroller also may be responsive to a feedback signal from a temperature sensor 147, for example, in or near the LEDs of the array 111.

As shown in FIG. 6, the electrical system may also include one or more control inputs 133 for inputting information instructing the microcontroller 22 as to the desired operational settings. A number of different types of inputs may be used and several alternatives are illustrated for convenience. A given installation may include a selected one or more of the illustrated control input mechanisms.

As one example, user inputs may take the form of a number of potentiometers 135. The number would typically correspond to the number of different light colors provided by the particular LED array 111, e.g., red, green and blue in this first example. The potentiometers 135 may connect through one or more analog to digital conversion interfaces provided by the microcontroller 22 (or in associated circuitry). To set the desired parameters for the integrated light output, the user may adjust the potentiometers 135 to set the intensity for each color which correlates to color coordinate. The microcontroller 22 senses the input settings and controls the LED driver circuits accordingly, to set appropriate actual intensity levels for the LEDs providing the light of the various colors. An additional potentiometer may provide an overall intensity or dimming input.

Another user input implementation might utilize one or more dip switches 137. For example, there might be a series of such switches to input a code corresponding to one of a number of recipes. The memory used by the microcontroller 22 would store the necessary color coordinate information for each recipe. Based on the input code, the microcontroller 22 retrieves the appropriate recipe from memory. Then, the microcontroller 22 controls the LED driver circuits 21*a* to 21*c* accordingly, to set appropriate intensity levels for the LEDs 15 to 17 providing the light of the various colors. A similar set of switches could be used as a dimmer setting.

As an alternative or in addition to the user input in the form of potentiometers 135 or dip switches 137, the microcontroller 22 may be responsive to control data supplied from a separate source or a remote source. For that purpose, some versions of the system will include one or more communication interfaces. One example of a general class of such interfaces is a wired interface 139. One type of wired interface typically enables communications to and/or from a personal computer or the like, typically within the premises in which a lighting system operates. Examples of such local wired interfaces include USB, RS-232, and wire-type local area network (LAN) interfaces. Other wired interfaces, such as appropriate modems, might enable cable or telephone line communications with a remote computer, typically outside the premises. Other examples of data interfaces provide wireless communications, as represented by the interface 141. Wireless interfaces, for example, use radio frequency (RE) or infrared (IR) links. The wireless communications may be local on-premises communications, analogous to a wireless local area network (WLAN). Alternatively, the wireless communications may enable communication with a remote device outside the premises, using wireless links to a wide area network. Via such communications, a user can operate a compatible remote device to input information relating to a desired color characteristic (e.g., corresponding to coordinates for a target point in a color space). The user may also input information effectively specifying an overall output level, for dimming or the like.

The electrical components may also include one or more feedback sensors 143, to provide system performance measurements as feedback signals to the control logic, implemented in this example by the microcontroller 22. A variety of different sensors may be used, alone or in combination, for different applications. In the illustrated example, the set 143 of feedback sensors includes a temperature sensor 147. Although not shown, other sensors, such as an overall intensity sensor may be used. The sensors are positioned in or around the system to measure the appropriate physical condition, e.g. temperature, color, intensity, etc.

The temperature sensor 147 may be a simple thermo-electric transducer with an associated analog to digital converter, or a variety of other temperature detectors may be used. The temperature sensor is positioned on or inside of the lighting system, typically at a point that is near the LEDs or other sources that produce most of the system heat. The temperature sensor 147 provides a signal representing the measured temperature to the microcontroller 22. The system logic, here implemented by the microcontroller 22, can adjust intensity of one or more of the LEDs in response to the sensed temperature, e.g. to reduce intensity of the source outputs to compensate for temperature increases. The program of the microcontroller 22, however, would typically manipulate the intensities of the various LEDs so as to maintain the desired color balance between the various wavelengths of light used in the system, even though it may vary the overall intensity with temperature, or alternatively, drive the LEDs harder to maintain the intensity.

The above discussion of FIG. 6 is related to programmed digital implementations of the control logic, although the control also may be implemented using analog circuitry. FIG. 6 also depicts an example using red (R), green (G) and blue (B) LEDs. The color correction procedures under consideration here, however, are applicable in other control arrangements and/or in systems utilizing different colors of LEDs in three or more control channels.

Figure 7:
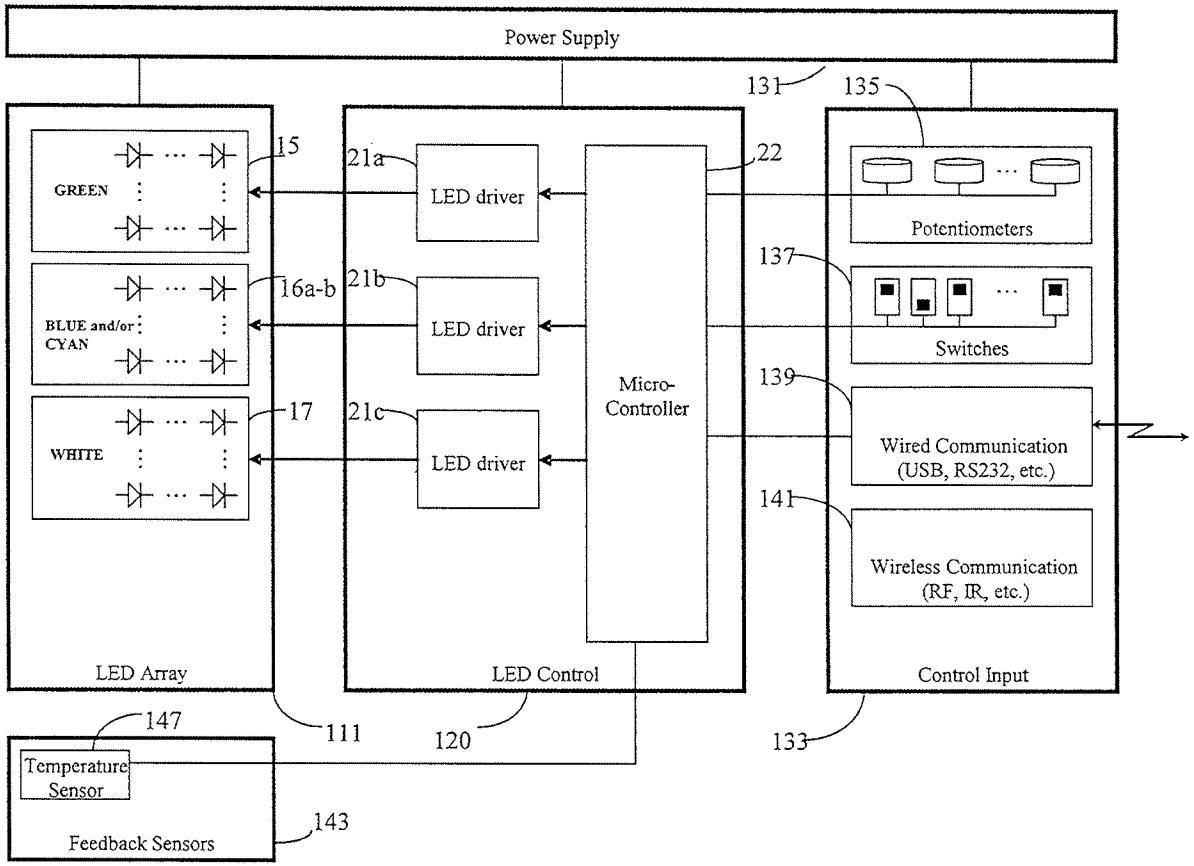
FIG. 7 is a functional block diagram of the electrical components of another example of a light emitting system using programmable digital control logic, where three channels drive three color light sources, i.e., Green LEDs, a combination of Blue and/or Cyan LEDs, and White LEDs, respectively.

FIG. 7 is a block diagram of another example of circuitry for light sources and associated control circuit, providing digital programmable control. This circuit example has a configuration similar to the configuration of the circuit example of FIG. 6, and where appropriate, similar elements are identified by the same reference numerals. Thus, the description of the same components as those of FIG. 6 will be omitted. The array 111 includes at least one Green LED 15, at least one White LED 17, and at least one Blue LED and/or at least one Cyan LED in the second control channel (i.e., 16*a*-16*b*). The three driver circuits 21*a*, 21*b* and 21*c* drive three color light sources, i.e., the Green LEDs 15, the Blue/Cyan LEDs 16*a*-16*b* and the White LEDs 17, respectively.

Figure 8:
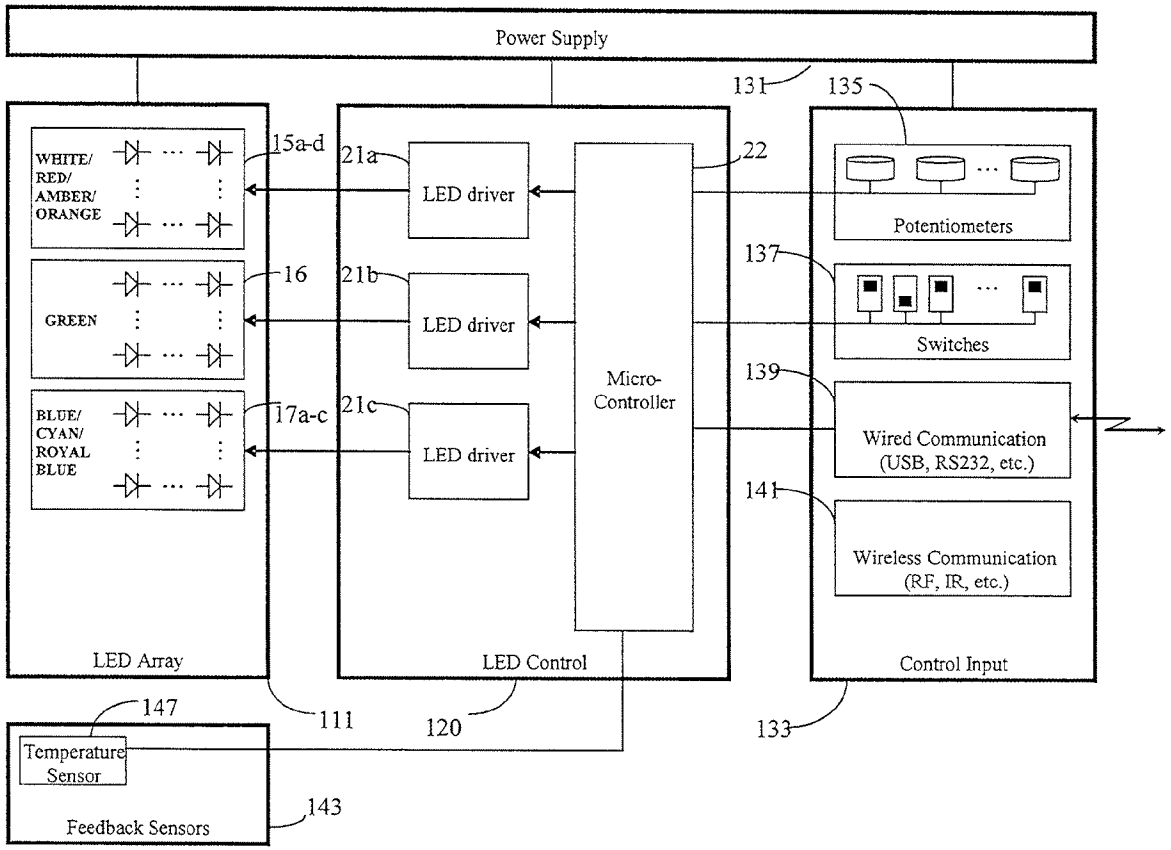
FIG. 8 is a functional block diagram of the electrical components of still another example of a light emitting system using programmable digital control logic, where three channels drive three color light sources, i.e., a combination of White, Red, Amber and Orange LEDs, Green LEDs, and a combination of Blue, Cyan and Royal Blue LEDs, respectively.

FIG. 8 is a block diagram of still another example of circuitry for light sources and associated control circuit, providing digital programmable control. This circuit example has a configuration similar to the configuration of the circuit example of FIG. 6, and where appropriate, similar elements are identified by the same reference numerals. Thus, the description of the same components as those of FIG. 6 will be omitted. The array 111 includes at least one Green LED 16, at least one White LED in series with at least one Red and/or Amber and/or Orange LED (i.e., 15*a*-15*c*), and at least one Blue LED in series with at least one Cyan and/or Royal Blue LED (i.e., 17*a*-17*c*). The three driver circuits 21*a*, 21*b* and 21*c* drive three color light sources, i.e., the Red/Amber/Orange LEDs 15*a*-15*c*, the Green LEDs 16 and the Blue/Cyan/Royal Blue LEDs 17*a*-17*b*, respectively.

Figure 9:
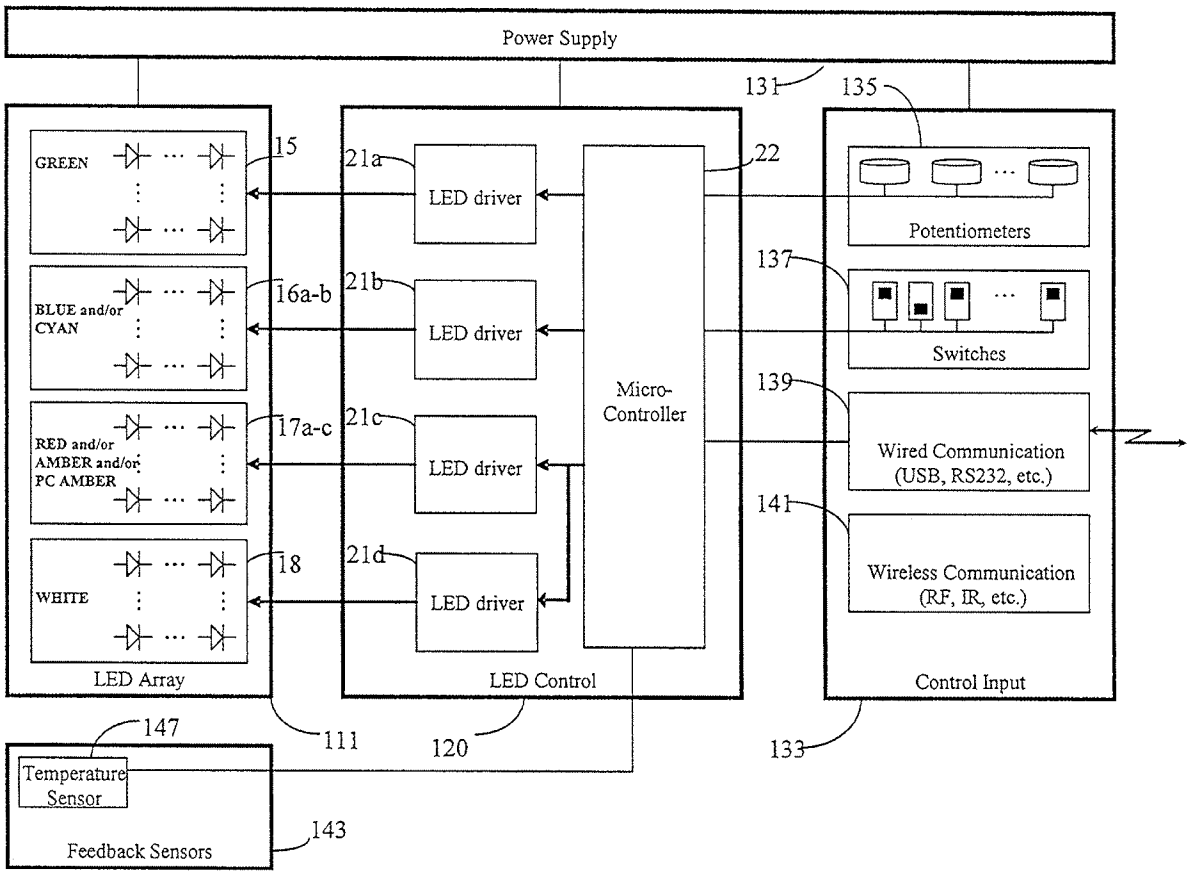
FIG. 9 is a functional block diagram of the electrical components of still another example of a light emitting system using programmable digital control logic, where four channels drive four color light sources, i.e., Green LEDs, a combination of a Blue and/or Cyan LEDs, a combination of Red and/or Amber and/or PC Amber LEDs, and White LEDs, respectively.

FIG. 9 is a block diagram of still another example of circuitry for light sources and associated control circuit, providing digital programmable control. This circuit example has a configuration similar to the configuration of the circuit example of FIG. 6, and where appropriate, similar elements are identified by the same reference numerals. Thus, the description of the same components as those of FIG. 6 will be omitted. The system 120 includes driver circuits 21*a*-21*d* for the various LEDs and the microcontroller 22. The system may also include one or more digital to analog converters (DACs) (not separately shown). In this regard, the microcontroller 22 may control the DACs, which in turn provide signals to the respective drivers 21*a* to 21*d*. The analog current output level of each of the driver circuits 21*a* to 21*d* may be controlled by a higher level logic of the system. The array 111 includes at least one Green LED in the first control channel (i.e., 15), at least one Blue LED and/or at least one Cyan LED in the second control channel (i.e., 16*a*-16*b*), at least one Red LED and/or at least one Amber LED and/or at least one Phosphor-Converted (PC) Amber LED in the third control channel (i.e., 17*a*-17*c*), and at least one White LED in the fourth control channel 18. The four driver circuits 21*a*-21*d* drive four color light sources, i.e., the Green LEDs 15, the Blue/Cyan LEDs 16*a*-16*b* and the Red/Amber/PC Amber LEDs 17*a*-17*c*, and the White LEDs 18, respectively. The microcontroller 22 receives control inputs specifying the particular 'recipe' or mixture. The input information will include or can be translated to color coordinates of a target point, for a desired color characteristic for the combined output light from the system. The input information may also indicate an overall intensity or dimming level. Then, the microcontroller 22 controls the LED driver circuits 21*a* to 21*d* accordingly, to set appropriate intensity levels for the LEDs 15 to 18 providing the light of the various colors. Referring to FIG. 9, the microcontroller 22 controls the four LED driver circuits 21*a*-21*d* through three logical channels (indicated by three control lines originated from the microcontroller 22 to the LED drivers 21*a*-21*c*). More particularly, the first and second logical channels are used to control the driver circuits 21*a* and 21*b*, respectively, while the third logical channel is used to commonly control the two driver circuits 21*c* and 21*d*. Thus, with this circuit configuration of FIG. 9, LED control algorithms based on three logical channels can be applied to the four color light sources 15-18. Furthermore, with an appropriate mapping between three logical channels and more than three color light sources, such control algorithms based on three logical channels can be applied to any number of color light sources, each source with any number of varieties of LEDs or other light emitters.

Similar color correction procedures can be implemented in any system having three or more channels of control of different color LED sources, such as in the four examples of FIGS. 6-9. It may be easiest to understand the nuances of the methodology using three primary colors, such as RGB, by way of an example. Hence, in the following paragraphs, an example of general lighting system for color correction with the circuit configuration of FIG. 6 will be described. However, this lighting system can operate with other circuit configurations, including the configuration of FIGS. 7-9, in a similar manner, e.g., only with changes in the configuration of the LEDs 15-17 (see FIGS. 7 and 8) or with an addition of more color light sources (see FIG. 9). That is, the microcontroller 22 is coupled to control the three LED elements 15-17 in the array 111 (as in FIGS. 6-8) or the three logical channels (as in FIG. 9) to produce a color corrected output light.

Referring to FIG. 6, in this example of a lighting system, the microcontroller 22 is coupled to control the three LED elements 15-17 in the array 111 to produce a color corrected output light having a desired color characteristic corresponding to a target color point dimmed to a target proportion of a maximum target intensity. The target color point with the target proportion represents the desired color characteristic for a combined light output with the target proportion of the maximum target intensity, for which the LEDs 15-17 are controlled to produce a color corrected combined output light. In this lighting system, coordinates of the target color point are input to the microcontroller 22. The coordinates represent the target color point in a first color space, e.g., as an xy chromaticity point in CIE 1931 color space. The CIE 1931 color space defines a color point and intensity expressed as a CIE 1931 xyY chromaticity coordinate where the Y portion is a percentage of maximum intensity at that xy chromaticity. The target intensity proportion is also input to the microcontroller 22, e.g., as a fraction or percentage of a maximum intensity. In order to produce a color corrected light output for the target color point with the target intensity proportion, the microcontroller may perform a color correction, and control the LED drivers 21*a*-21*c* to adjust LED settings, e.g., to proportionally adjust input settings with the proportion of the maximum intensity for each type of LED light emission (e.g., Red, Green or Blue), based on a result of the color correction.

Figure 10A:
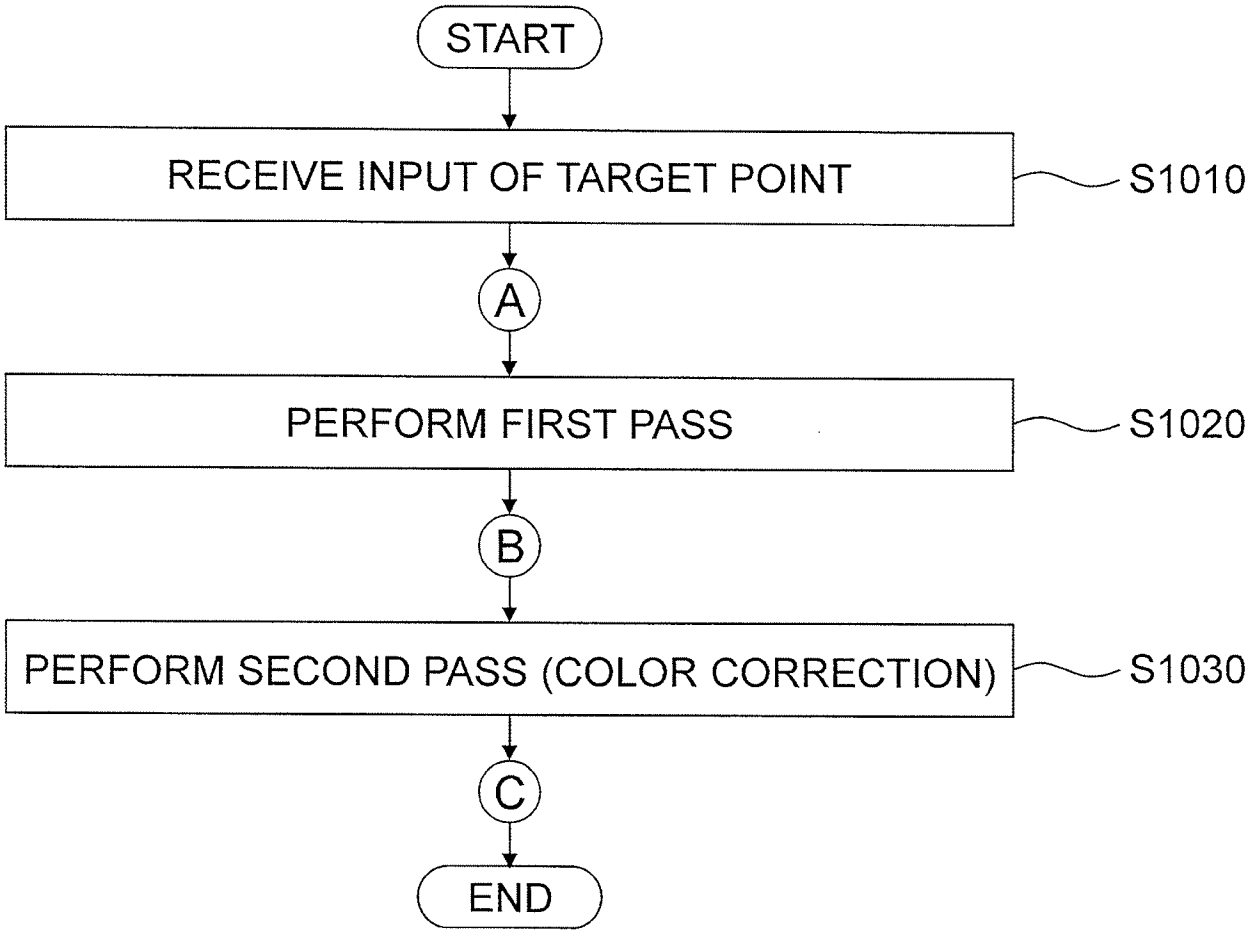
FIG. 10A is a flow chart, illustrating an example of a color correction method with two computation passes.
Figure 10B:
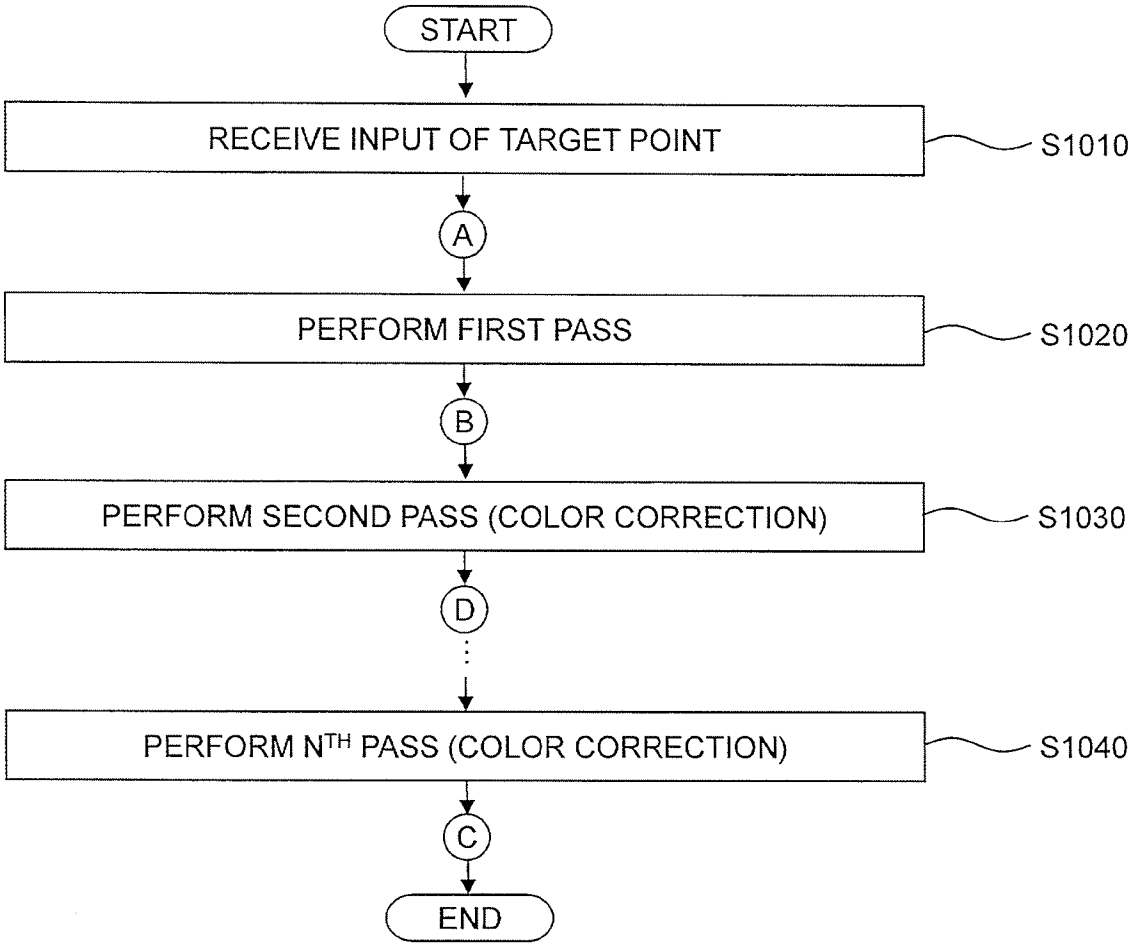
FIG. 10B is a flow chart, illustrating an example of a color correction method with n computation passes (n>2).

FIG. 10A is a flow chart, illustrating an example of a color correction method with two computation passes. Referring to FIG. 10A, in order to perform the color correction control, microcontroller 22 receives an input relating to or otherwise obtains color coordinates of the target point defined in the first color space, e.g., the CIE 1931 color space (S1010). The microcontroller 22 then performs two (first and second) computation passes (S1020 and S1030 in FIG. 10A) to determine respective driver settings for the LEDs 15-17 as will be described in the following paragraphs. Because the currents flowing through the LEDs at the LED settings as a result of the first computation pass and the current density thereof are not known until the first computation pass is completed, for improved accuracy, the microcontroller 22 performs the second computation pass (S1030) to correct for the effect of the current density reduction due to the proportionally adjusted input settings. In other words, the first pass output is a best guess, given the information at hand, while the second computation pass uses that information to perform the color correction control with the proportionally adjusted intensity settings of the LEDs at those current densities. Referring to FIG. 10B, this process may be iterative, so that a third computation pass (S1040) may result in even more accurate color corrected results.

Figure 11A:
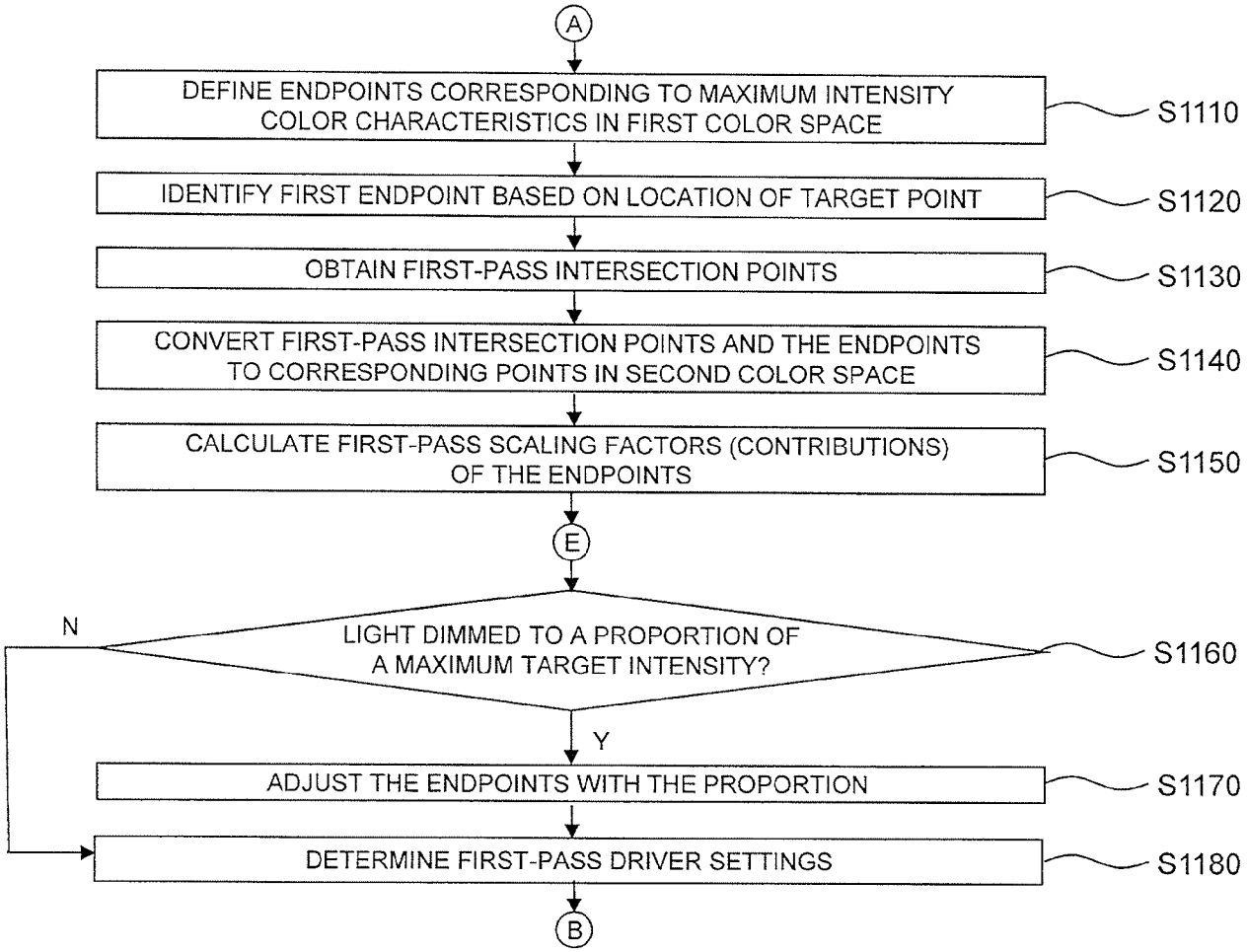
FIG. 11A is a flow chart, illustrating an example of the first computation pass of a color correction method.
Figure 11B:
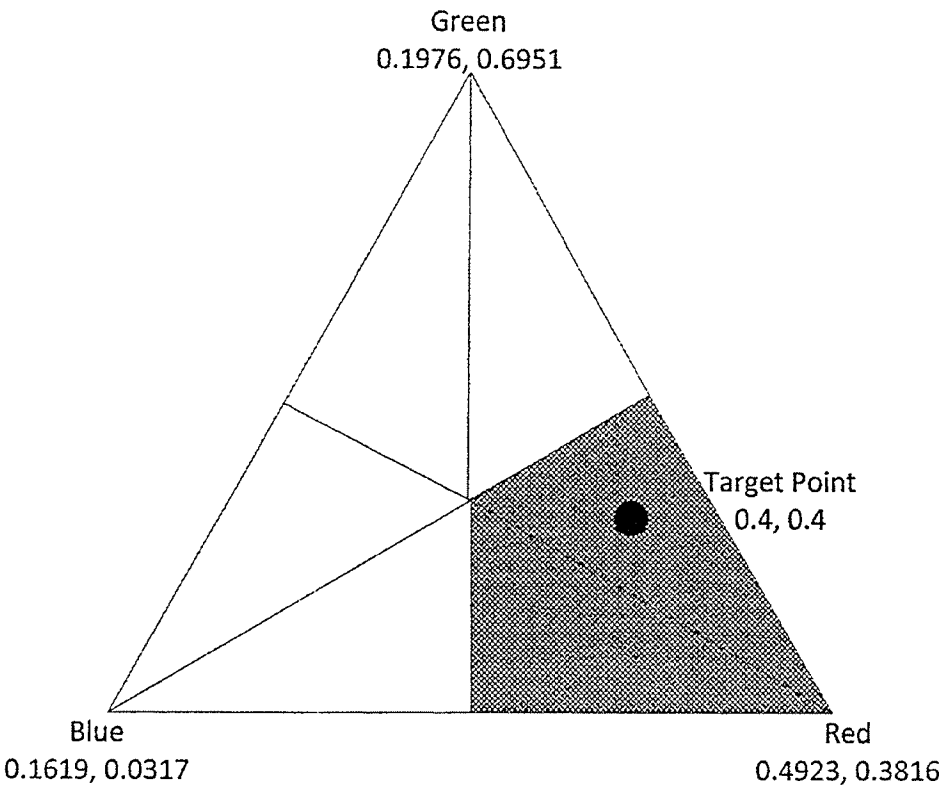
FIG. 11B is a color volume diagram, useful in understanding a step of the first computation pass of a color correction method, for determining a region of a target point in a first color space.

FIG. 11A is a flow chart, illustrating an example of the first computation pass of a color correction method. The color volume diagram of FIG. 11B illustrates a step of defining endpoints corresponding to maximum intensity color characteristics in the first color space (S1110 in FIG. 11A). More particularly, referring to FIG. 6, the microcontroller 22 first defines a first output volume (e.g., the triangular area with three vertices Red, Green and Blue, as shown in FIG. 11B) in the first color space to have boundaries with three endpoints, denoted by Red, Green and Blue in FIG. 11B. The Red, Green and Blue endpoints correspond to color characteristics of three color light sources, e.g., the Red LEDs 15, Green LEDs 16 and Blue LEDs 17 (see FIG. 6), respectively, when the LEDs 15-17 are operated at or near respective maximum intensities. That is, the first output volume defined with these endpoints represents an uncorrected color of a light emitted from the LEDs 15-17 that are full ON. Alternatively, the first volume is defined with the endpoints corresponding to the LEDs 15-17, at least one of which is full ON. Accounting for a desired light output of less than full ON of any colors will be accounted for later in the first computation pass. The first output volume may be pre-programmed into the programmable microcontroller 22 (see FIG. 6 and the related descriptions above).

Referring to FIG. 11B, the center point of the first output volume can either be the sum of the three endpoints or be based on pre-programmed data of the microcontroller 22. The microcontroller 22, after defining the first output volume, identifies a first endpoint, e.g., Red in FIG. 11B, among the three endpoints, as a region where the target point lies, based on the location of the target point (0.4, 0.4) in the first volume (S1120 in FIG. 11A).

The microcontroller 22, after determining the first endpoint, determines first-pass light amounts of respective maximum intensity light contributions from the LEDs 15-17 to achieve light at the target point. More particularly, the microcontroller 22 determines what the other two endpoints (e.g., Green and Blue), other than the identified first endpoint (e.g., Red), must contribute their respective maximum intensity amounts to achieve the desired target CIE1931 xy color point at (0.4, 0.4). In order to determine the respective first-pass light contribution amounts, the microcontroller 22 first obtains two first-pass intersection points (e.g., $\text{Target}_{rb}$) located in the first volume (S1130 in FIG. 11A), and then calculates respective first-pass scaling factors, i.e., respective first-pass light contribution amounts, based on the obtained the first-pass intersection points (S1150 in FIG. 11A).

Figure 11C:
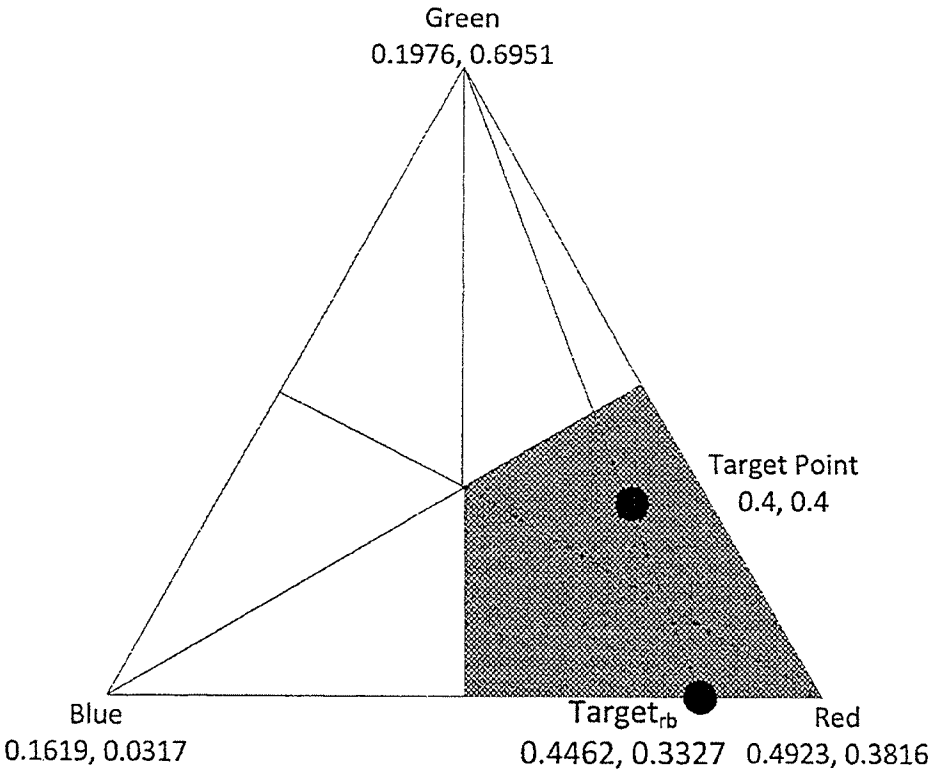
FIG. 11C is a color volume diagram, useful in understanding another step of the first computation pass of a color correction method, for obtaining a first-pass intersection point.

The color volume diagram of FIG. 11C illustrates a step of obtaining the first-pass intersection points (S1130 in FIG. 11A). In this step, the microcontroller 22 obtains a first first-pass intersection point (e.g., $\text{Target}_{rb}$ in FIG. 11C), at which a line connecting the target point and the Green endpoint intersects a boundary line connecting the identified first endpoint (Red) and the Blue endpoint. This first intersection point $\text{Target}_{rb}$ is used to calculate the amount of Blue that must be added to the FULL ON Red to produce the desired target point when Green is removed. Similarly, the microcontroller 22 obtains a second first-pass intersection point (e.g., $\text{Target}_{rg}$), at which a line connecting the target point and the Blue endpoint intersects a boundary line connecting the identified first endpoint (Red) and the Green endpoint. This second intersection point $\text{Target}_{rg}$ is used to calculate the amount of Green that must be added to the FULL ON Red to produce the desired target point when Blue is removed. The microcontroller 22 then converts the obtained two first-pass intersection points $\text{Target}_{rb}$ and $\text{Target}_{rg}$, and the Red, Blue and Green endpoints, into corresponding points in a second color space, e.g., the CIE Tristimulus XYZ color space (S1140 in FIG. 11A). For example, a point $[x\ y\ Y_1]^{-1}$ in CIE xyY coordinates can be converted to a converted point $[X\ Y_2\ Z]^{-1}$ in CIE Tristimulus XYZ color space using Equation (1). This conversion is performed, because the CIE XYZ color space is more uniform with intensity than the CIE xyY color space (chromaticity plus intensity), thereby achieving higher accuracy and efficiency than the CIE xyY color space achieves.

$$X = Y_1 \times \frac{x}{y},\ Y_2 = Y_1,\ Z = Y_1 \times \frac{1-x-y}{y} \qquad \text{Equation (1)}$$

After the conversion is performed, the microcontroller 22 calculates respective first-pass scaling factors $S_b$ and $S_g$ of the converted Blue and Green endpoints using Equations (2) and (3), respectively (S1150 in FIG. 11A). That is, each of the converted first-pass intersection points (e.g., $[X_{trb}\ Y_{trb}\ Z_{trb}]^{-1}$ and $[X_{trg}\ Y_{trg}\ Z_{trg}]^{-1}$) is obtained by adding, to the converted first endpoint (e.g., $[X_r\ Y_r\ Z_r]^{-1}$), one of the converted Blue endpoint multiplied by the first-pass scaling factor thereof (e.g., $S_b \times [X_b\ Y_b\ Z_b]^{-1}$), and the converted Green endpoint multiplied by the first-pass scaling factor thereof (e.g., $S_g \times [X_g\ Y_g\ Z_g]^{-1}$). Each of these scaling factors depicts the percentage contribution of each of the Blue and Green endpoints to produce the desired target point. The microcontroller 22 may also calculate the first-pass scaling factor $S_r$ of the Red endpoint, which may be 1, i.e., 100% contribution to produce the desired target point.

$$\begin{bmatrix} X_r \\ Y_r \\ Z_r \end{bmatrix} + \begin{bmatrix} X_b \\ Y_b \\ Z_b \end{bmatrix} \times S_b = \begin{bmatrix} X_{trb} \\ Y_{trb} \\ Z_{trb} \end{bmatrix},\ S_b = \frac{y_b X_r - x_b Y_r}{x_b Y_b - y_b X_b} \qquad \text{Equation (2)}$$

$$\text{where } x_b = \frac{X_{trb}}{X_{trb} + Y_{trb} + Z_{trb}},\ y_b = \frac{Y_{trb}}{X_{trb} + Y_{trb} + Z_{trb}}$$

$$\begin{bmatrix} X_r \\ Y_r \\ Z_r \end{bmatrix} + \begin{bmatrix} X_g \\ Y_g \\ Z_g \end{bmatrix} \times S_g = \begin{bmatrix} X_{trg} \\ Y_{trg} \\ Z_{trg} \end{bmatrix},\ S_g = \frac{y_g X_r - x_g Y_r}{x_g Y_g - y_g X_g} \qquad \text{Equation (3)}$$

$$\text{where } x_g = \frac{X_{trg}}{X_{trg} + Y_{trg} + Z_{trg}},$$

$$y_g = \frac{Y_{trg}}{X_{trg} + Y_{trg} + Z_{trg}}$$

For example, the Red endpoint $[0.4923\ 0.3816\ 894]^{-1}$ converts to $[X_r\ Y_r\ Z_r]^{-1} = [1154\ 894\ 295]^{-1}$, and the Blue endpoint $[0.1619\ 0.0317\ 71]^{-1}$ converts to $[X_b\ Y_b\ Z_b]^{-1} = [361\ 71\ 1801]^{-1}$. With these converted points, the first-pass scaling factor $S_b = 0.1705$ is obtained using Equation (2).

The microcontroller 22, after calculating the first-pass scaling factors, determines whether the target proportion of the maximum target intensity is input to the microcontroller 22 (S1160 in FIG. 11A). When it is determined that the target proportion is not given as input to the microcontroller 22, the microcontroller 22 then determines first-pass driver settings, i.e., initial driver settings, for the LEDs 15-17 based only on the determined first-pass scaling factors $S_r$, $S_g$ and $S_b$ (S1180 in FIG. 11A). When it is determined that the target proportion, e.g., Q (%), is given as input to the microcontroller 22, before the first-pass driver settings are determined (S1180 in FIG. 11A), the microcontroller 22 adjusts the converted endpoints in accordance with the determined first-pass scaling factors $S_r$, $S_g$ and $S_b$ and with the target proportion Q (%) (S1170 in FIG. 11A). More particularly, in performing the adjustment (S1170 in FIG. 11A), the converted first (e.g., Red) endpoint is multiplied by its first-pass scaling factor $S_r$ and by the target proportion Q. Similarly, the converted Blue endpoint is multiplied by its first-pass scaling factor $S_b$ and by the target proportion Q, and the converted Green endpoint is multiplied by its first-pass scaling factor $S_g$ and by the target proportion Q. Alternatively, instead of scaling all of X, Y, Z Tristimulus coordinates of each endpoint by its scaling factor and the target proportion, only one of the three Tristimulus coordinates may be scaled. The largest Tristimulus among three coordinates may be chosen for a higher level of accuracy. For example, a Blue endpoint typically has a higher Z Tristimulus than X or Y, thus only 4 is chosen to be scaled using Equation (4). When the target proportion Q=50%, the scaled $Z_b = Z_{b,scaled} = 1801 \times 0.1705 \times 50/100 = 153.5$ is obtained using Equation (4).

$$Z_b \times S_b \times \frac{\%Q}{100} = Z_{b,scaled} \quad \text{Equation (4)}$$

In order to determine the first-pass driver settings for the LEDs 15-17 (S1180 in FIG. 11A), the microcontroller converts the scaled Tristimulus for each endpoint into a driver setting. The conversion is performed using pre-programmed data, which are based on manufacturer performance data or actual measured performance data. Such pre-programmed data can take many forms, including a look up table which may or may not include interpolation, or transfer functions. For example, the following Function (1) expresses a transfer function whose output is the driver setting value for a Blue LED for an input argument α of a scaled Tristimulus $Z_{b,scaled}$. Using Function (1), when $Z_{b,scaled}=153.5$, the Blue LED driver setting value of 55186 can be obtained.

$$0.000635\alpha^2 - 34.07 \times \alpha + 60401 \quad \text{Function (1)}$$

At this stage, three first-pass driver channel settings for the LEDs 15-17 (see FIG. 6) have been calculated, assuming that the first output volume is generated with each LED channel full ON. If these three LEDs were to be set at the above-calculated first-pass driver settings, the lighting system would still produce an uncorrected light output, because the changes in chromaticity of the LEDs due to the current density reduction with the proportionally adjusted driver settings (e.g., driver settings obtained using Equation (4) and Function (1)) would not be accounted for. To account for the effects of the current density reduction, the second computation pass may be performed as will be described in the following paragraphs.

Figure 12A:
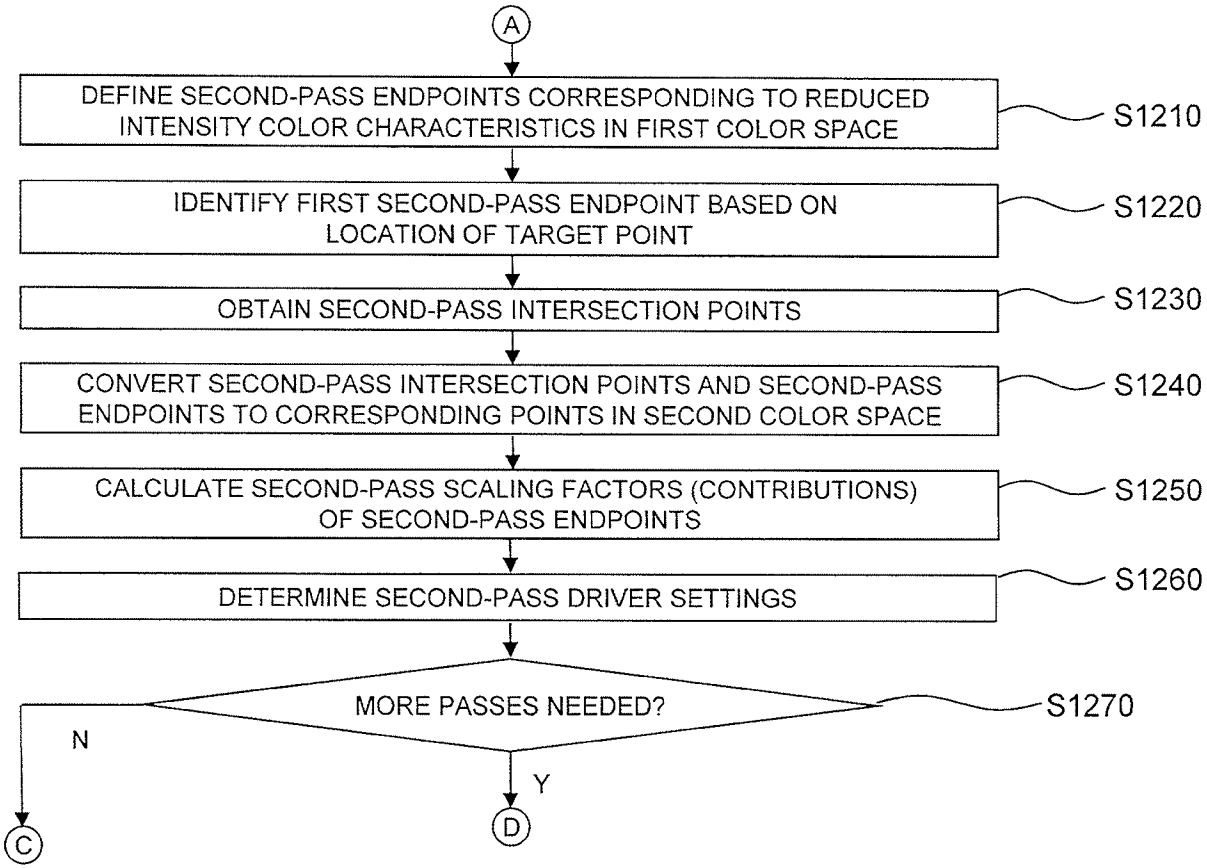
FIG. 12A is a flow chart, illustrating an example of the second computation pass of a color correction method.
Figure 12B:
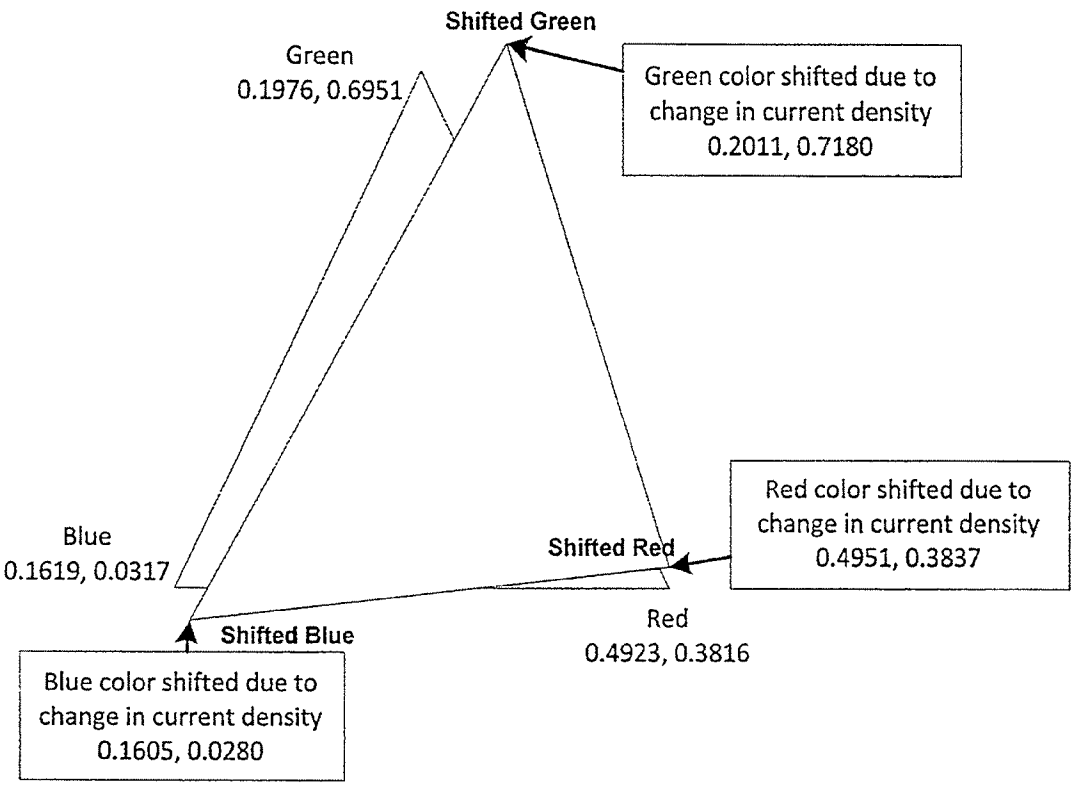
FIG. 12B is a color volume diagram, useful in understanding a step of the second pass of a color correction method, for defining three endpoints based on driver settings determined in the first computation pass.

FIG. 12A is a flow chart, illustrating an example of the second computation pass of a color correction method. The color volume diagram of FIG. 12B illustrates a step of defining second-pass endpoints corresponding to reduced intensity color characteristics in the first color space (S1210 in FIG. 12A). In this step, the microcontroller 22 defines a second output volume (e.g., the new triangular area overlaying the triangular area of the first output volume, as shown in FIG. 12B) to have boundaries with three endpoints (those denoted by Shifted Red, Shifted Green and Shifted Blue in FIG. 12B). Those Shifted Red, Green and Blue endpoints correspond to color characteristics of three color light sources, e.g., the Red LEDs 15, Green LEDs 16 and Blue LEDs 17 (see FIG. 6), respectively, when the LEDs 15-17 are operated at the first-pass driver settings, which have been determined in the first computation pass. Since the adjustment has been performed with a reduced portion of the maximum target intensity in the first computation pass, the Shifted endpoints correspond to reduced color characteristics of the Red LEDs 15, Green LEDs 16 and Blue LEDs 17. That is, this second output volume represents an uncorrected color of a light emitted from the LEDs 15-17 that are driven with the driver settings, determined or adjusted in the first computation pass.

More particularly, this new second output volume may be established based on the resulting output of the first computation pass, using pre-programmed performance data. These performance data provide a relationship between the driver setting for each LED and the XYZ Tristimulus output of the lighting system. For example, the following Function (2) expresses a transfer function whose output is the X Tristimulus coordinate $X_b$ for a Blue LED output for an input argument α of a driver setting value for the Blue LED output. Using Function (2), when α=55186, the Tristimulus coordinate $X_b$=158.04 can be obtained. In this manner, nine transformations may be performed, three (one for X, one for Y, and one for Z) for each of the three colors. Further, the obtained three sets of XYZ Tristimulus coordinates are converted to CIE1931 xyY coordinates, thereby forming the new second output volume defined in the first color space.

$$3.57 \times 10^{-8} \times \alpha^2 - 0.03254\alpha + 1845.14 \quad \text{Function (2)}$$

Figure 12C:
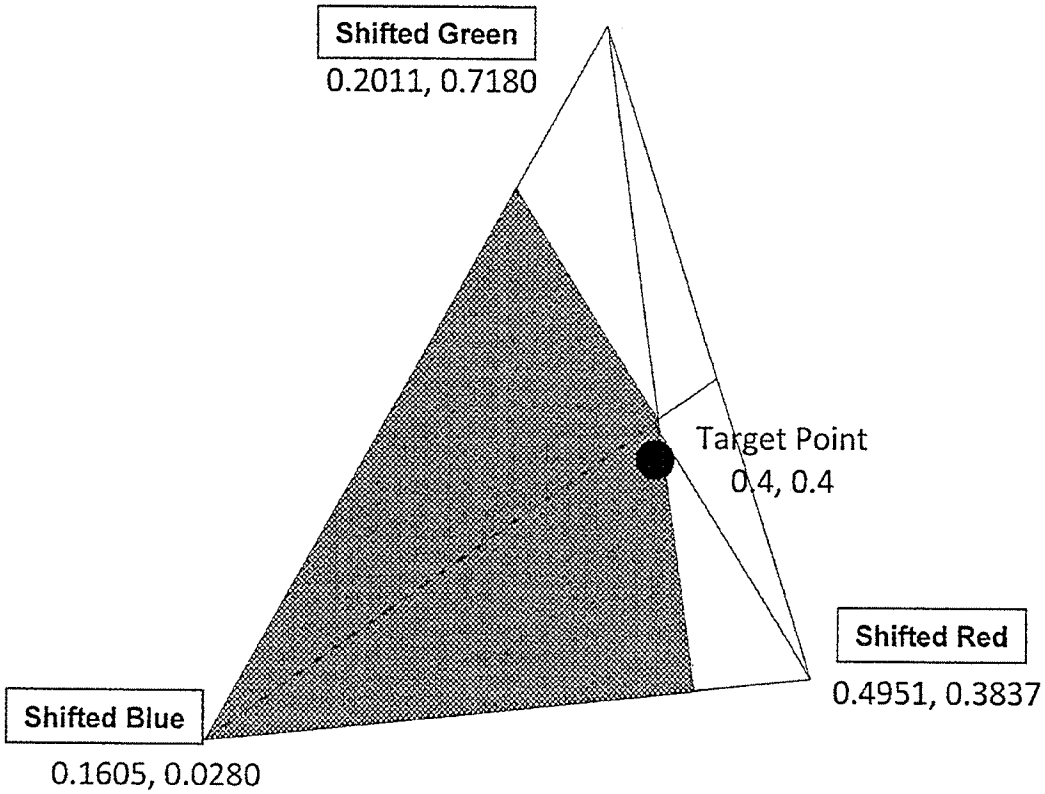
FIG. 12C is a color volume diagram, useful in understanding another step of the second computation pass of a color correction method, for determining a region of the target point in the first color space.

The color volume diagram of FIG. 12C illustrates a step of identifying a first second-pass endpoint based on location of the target point (S1220 in FIG. 12A). Referring to FIG. 12C, the center point of the second output volume can either be the sum of the three Shifted endpoints or be based on pre-programmed data of the microcontroller 22 (see FIG. 6 and the related description above). It is noted that the center point of the second output volume also has shifted due to dimmed lights output from the three LEDs 15-17 driven at the determined or adjusted driver settings of the first pass. The microcontroller 22 then identifies a first Shifted endpoint, e.g., Shifted Blue in FIG. 12C, among the three Shifted endpoints, as a region where the target point lies in the second volume, based on the location of the target point (0.4, 0.4) in the second volume.

The microcontroller 22, after determining the first Shifted endpoint, determines second-pass light amounts of respective reduced intensity light contributions from the LEDs 15-17 to achieve light at the target point, in a manner similar to that of the first pass. More particularly, the microcontroller 22 determines what the other two Shifted endpoints (e.g., Red and Green), other than the identified first Shifted endpoint (e.g., Blue), must contribute their respective reduced intensity amounts to achieve the desired target CIE1931 xy color point at (0.4, 0.4). In order to determine the respective second-pass light contribution amounts, the microcontroller 22 first obtains two second-pass intersection points (e.g., $Target_{rb}$ in FIG. 12D) located in the second volume, and then calculates respective second-pass scaling factors, i.e., respective second-pass light contribution amounts, based on the obtained the second-pass intersection points.

Figure 12D:
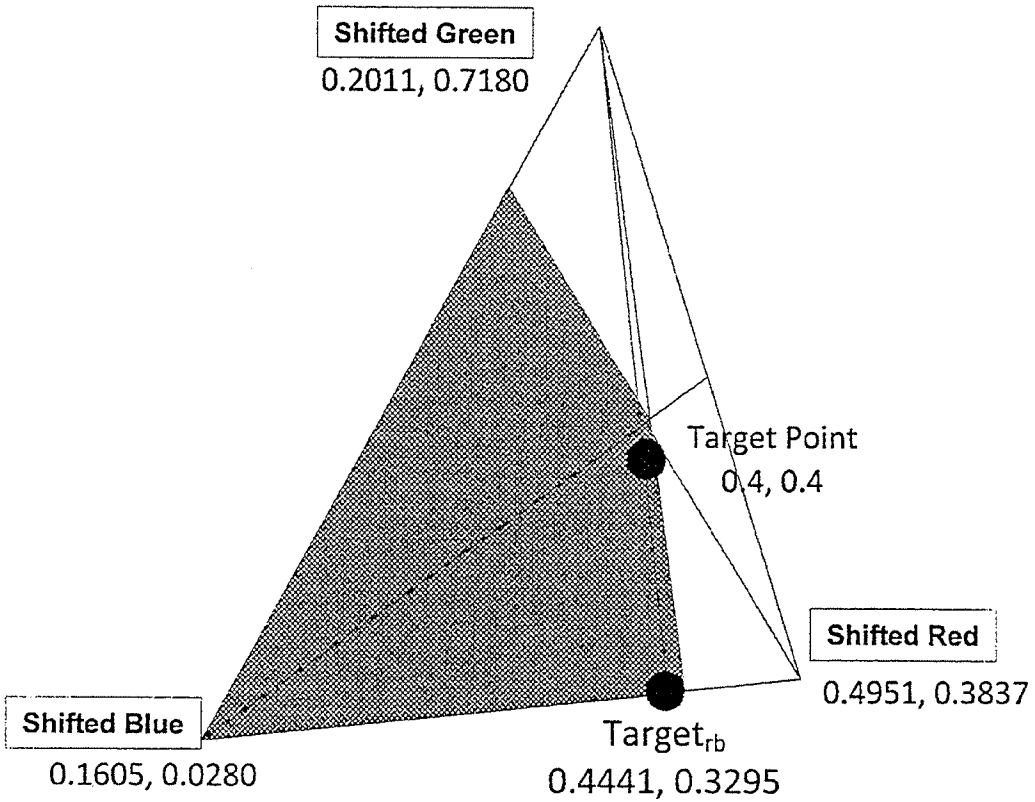
FIG. 12D is a color volume diagram, useful in understanding still another step of a color correction method, for obtaining a second-pass intersection point.

The color volume diagram of FIG. 12D illustrates a step of obtaining two second-pass intersection points (S1230 in FIG. 12A). In this step, the microcontroller 22 obtains a first second-pass intersection point (e.g., $Target_{rb}$ in FIG. 12D), at which a line connecting the target point and the Shifted Green endpoint intersects a boundary line connecting the identified first Shifted endpoint (Blue) and the Shifted Red endpoint. This first second-pass intersection point $Target_{rb}$ is used to calculate the amount of Shifted Red that must be added to the Shifted Blue to produce the desired target point when Shifted Green is removed. Similarly, the microcontroller 22 obtains a second second-pass intersection point (e.g., $Target_{gb}$), at which a line connecting the target point and the Shifted Red endpoint intersects a boundary line connecting the identified first endpoint (Blue) and the Shifted Green endpoint. This second intersection point $Target_{gb}$ is used to calculate the amount of Shifted Green that must be added to the Shifted Blue to produce the desired target point when Shifted Red is removed. The microcontroller 22 then converts the obtained two second-pass intersection points $Target_{rb}$ and $Target_{gb}$, and the Shifted Red, Shifted Blue and Shifted Green endpoints, into corresponding points in the second color space, e.g., the CIE Tristimulus XYZ color space (S1240 in FIG. 12A), using Equation (1). This conversion is performed, because the CIE XYZ color space is more uniform with intensity than the CIE xyY color space (chromaticity plus intensity), thereby achieving higher accuracy and efficiency than the CIE xyY color space achieves.

After the conversion is performed, the microcontroller 22 calculates respective second-pass scaling factors $S_r$ and $S_g$ of the converted Shifted Red and Green endpoints using Equations (5) and (6), respectively, which are similar to Equations (2) and (3) (S1250 in FIG. 12A). That is, each of the converted second-pass intersection points (e.g., $[X_{trb}\ Y_{trb}\ Z_{trb}]^{-1}$ and $[X_{tgb}\ Y_{tgb}\ Z_{tgb}]^{-1}$) is obtained by adding, to the converted first second-pass endpoint (e.g., Shifted Blue, $[X_b\ Y_b\ Z_b]^{-1}$), one of the converted Shifted Red endpoint multiplied by the second-pass scaling factor thereof (e.g., $S_r \times [X_r\ Y_r\ Z_r]^{-1}$), and the converted Shifted Green endpoint multiplied by the second-pass scaling factor thereof (e.g., $S_g \times [X_g\ Y_g\ Z_g]^{-1}$). Each of these second-pass scaling factors depicts the percentage contribution of each of the Shifted Red and Shifted Green endpoints to produce the desired target point. The microcontroller 22 may also calculate the second-pass scaling factor $S_b$ of the Shifted Blue endpoint, which may be 1, i.e., 100% contribution to produce the desired target point.

$$\begin{bmatrix} X_b \\ Y_b \\ Z_b \end{bmatrix} + \begin{bmatrix} X_r \\ Y_r \\ Z_r \end{bmatrix} \times S_r = \begin{bmatrix} X_{trb} \\ Y_{trb} \\ Z_{trb} \end{bmatrix}, S_r = \frac{y_r X_b - x_r Y_b}{x_r Y_r - y_r X_r} \quad \text{Equation (5)}$$

$$\text{where } x_r = \frac{X_{trb}}{X_{trb} + Y_{trb} + Z_{trb}}, y_r = \frac{Y_{trb}}{X_{trb} + Y_{trb} + Z_{trb}}$$

$$\begin{bmatrix} X_b \\ Y_b \\ Z_b \end{bmatrix} + \begin{bmatrix} X_g \\ Y_g \\ Z_g \end{bmatrix} \times S_g = \begin{bmatrix} X_{tgb} \\ Y_{tgb} \\ Z_{tgb} \end{bmatrix}, S_g = \frac{y_g X_b - x_g Y_b}{x_g Y_g - y_g X_g} \quad \text{Equation (6)}$$

$$\text{where } x_g = \frac{X_{tgb}}{X_{tgb} + Y_{tgb} + Z_{tgb}},$$

$$y_g = \frac{Y_{tgb}}{X_{tgb} + Y_{tgb} + Z_{tgb}}$$

For example, the Shifted Red endpoint [0.4951 0.3837 444]$^{-1}$ converts to $[X_r\ Y_r\ Z_r]^{-1}$=[573 444 140]$^{-1}$, and the Shifted Blue endpoint [0.1605 0.0280 5]$^{-1}$ converts to $[X_b\ Y_b\ Z_b]^{-1}$=[31 5 158]$^{-1}$. With these converted points, the second-pass scaling factor $S_r$=0.9359 is obtained using Equation (5).

The microcontroller 22, after calculating the second-pass scaling factors, determines second-pass driver settings, i.e., color corrected driver settings, for the LEDs 15-17 based on the determined second-pass scaling factors $S_r$, $S_g$ and $S_b$ (S1260 in FIG. 12A). It is noted that unlike the first computed pass, each converted Shifted endpoints is not scaled based on the target proportion of the maximum target intensity. That is, the microcontroller 22 adjusts the converted Shifted endpoints only in accordance with the determined second-pass scaling factors $S_r$, $S_g$ and $S_b$. More particularly, the converted Shifted Red endpoint is multiplied by its second-pass scaling factor $S_r$ using Equation (7). Similarly, the converted Shifted first (e.g., Blue) endpoint is multiplied by its second-pass scaling factor $S_b$, and the converted Shifted Green endpoint is multiplied by its second-pass scaling factor $S_g$. For example, when the X Tristimulus coordinate $X_r$=573 and the corresponding second-pass scaling factor $S_r$=0.9359, the scaled $X_r = X_{r,scaled}$=573×0.9359=536 is obtained using Equation (7).

$$X_r \times S_r = X_{r,scaled} \quad \text{Equation (7)}$$

In order to determine the second-pass driver settings for the LEDs 15-17, the microcontroller converts the scaled Tristimulus for each Shifted endpoint into a second-pass driver setting. The conversion is performed using pre-programmed data, which are based on manufacturer performance data or actual measured performance data. Such pre-programmed data can take many forms, including a look up table which may or may not include interpolation, or transfer functions. For example, the following Function (3) expresses a transfer function whose output is the second-pass driver setting value for a Red LED for an input argument α of a scaled Tristimulus $X_{r,scaled}$. Using Function (3), when $X_{r,scaled}$=536, the Shifted Red LED driver setting value of 34399 can be obtained.

$$-0.00319\alpha^2 - 46.94\alpha + 60475 \quad \text{Function (3)}$$

After the second-pass driver settings are determined, it is determined whether one or more passes are needed (S1270 in FIG. 12A). When it is determined that one or more passes are needed, the controller 22 performs the third computation pass (e.g., S1040 in FIG. 10A). Otherwise, by applying the determined second-pass driver settings to drive the LEDs 15-17, the lighting system can produce a color corrected output light having a desired color characteristic corresponding to the target point dimmed to the target proportion of the maximum target intensity.

Figure 13:
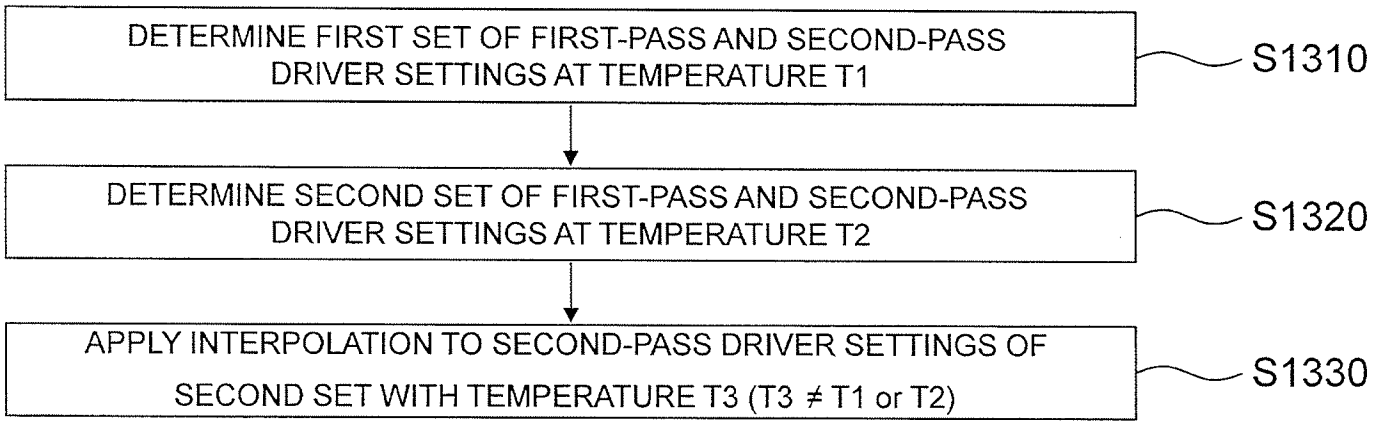
FIG. 13 is a flow chart, illustrating an example of a temperature correction extension of a color correction method.

FIG. 13 is a flow chart, illustrating an example of a temperature correction extension of the above-described color correction systems and methods. For example, referring to FIGS. 6-9, the microcontroller 22 controls the LEDs 15-17 or the LEDs 15-18 in the array 111 to correct for output changes of LEDs due to temperature changes. More particularly, the microcontroller 22 uses data on operation of the LEDs 15-17 or the LEDs 15-18 at a temperature $T_1$ to determine a first set of both the adjusted first-pass driver settings and the second-pass driver settings for the LEDs 15-17 or the LEDs 15-18 (S1310 in FIG. 13). Then, the microcontroller 22 uses data on operation of the LEDs 15-17 or the LEDs 15-18 at a temperature $T_2$ to determine a second set of both the adjusted first-pass driver settings and the second-pass driver settings for the LEDs 15-17 (S1320 in FIG. 13). The microcontroller 22 then applies an interpolation to at least the determined second-pass driver settings of the second set according to $T_3$, thereby obtaining an estimated set of second-pass driver settings for the LED system at $T_3$ (S1330 in FIG. 13). That is, multiple sets of pre-programmed performance data at different temperatures are created, and then the above-described color correction method is performed separately on multiple sets of data. Further, an interpolation is used on the multiple final driver settings. While any number of sets of data could be used, due to the linear nature of LED output performance changes over temperature, only two data sets may be used. The temperatures for these two data sets may be at opposite ends of the temperature operation range. The interpolation may be performed thereon linearly. Alternatively, referring to FIGS. 6-9, the microcontroller 22 may use performance data measured when the temperature sensor 147 provides a signal representing the measured temperatures of $T_1$, $T_2$ and $T_3$, to the microcontroller 22.

For another example of the temperature correction extension, a lighting system is first loaded with a first set of pre-programmed data measured at a certain temperature, 25° C. Next, the lighting system is loaded with an entire second set of pre-programmed data measured at 45° C. During operation, when a target CIE 1931 chromaticity point is inputted to the lighting system, the above-described first and second computation passes will be performed separately on the two sets of pre-programmed data. More particularly, the first and second passes will be performed using the 25° C. pre-programmed data, and then the first and second passes will be performed using the 45° C. pre-programmed data. As a result, two sets of driver channel settings are produced. Then, the actual temperature of the lighting system is measured with the temperature sensor 147 (see FIGS. 6-9). A linear interpolation of the two results sets may be used, based on the actual temperature of the lighting system. Alternatively, the lighting system uses a closed-loop feedback system to periodically monitor temperature changes and repeatedly perform, when the temperature changes, a color correction method to correct for the temperature change.

Figure 14:
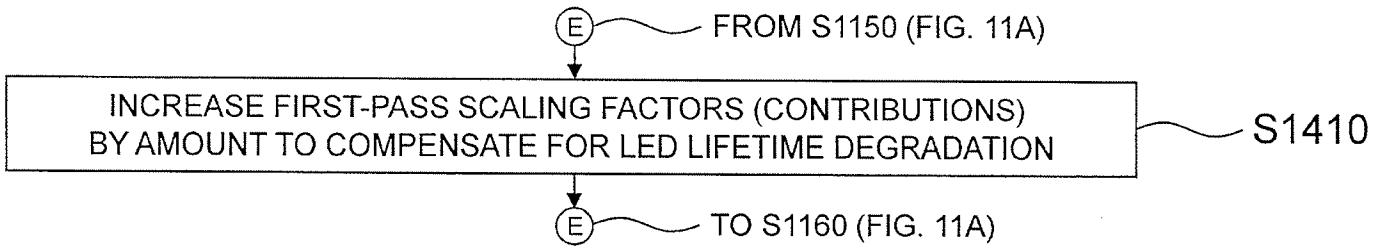
FIG. 14 is a flow chart, illustrating an example of a lifetime degradation correction extension of a color correction method.

FIG. 14 is a flow chart, illustrating an example of a lifetime degradation correction extension of the above-described color correction systems and methods. For example, referring to FIGS. 6-9, the microcontroller 22 controls the LEDs 15-17 or the LEDs 15-18 in the array 111 to correct for an output change due to an LED lifetime degradation during a particular period. More particularly, after calculating first-pass scaling factors (S1150 in FIG. 11A) and before determining whether a target proportion of a maximum target intensity is input to the microcontroller 22 (S1160 in FIG. 11A) in the first pass, the microcontroller 22 increases the determined first-pass scaling factors by an amount to compensate for the LED lifetime degradation during the particular period (S1410 in FIG. 14). Alternatively, in combination with this scaling compensation scheme, the microcontroller 22 uses data from a color sensor or use LED lifetime data to correct for lifetime degradation. For another example, if manufacturer's estimates show that after twenty thousand hours the Blue LED lumen output will have degraded by one percent, after twenty thousand hours of operation, in the above-described first computation pass, the scaling factor for the Blue LED will be bolstered by one percent to compensate.

In the aforementioned example of the flowchart shown in FIG. 14, lifetime degradation correction is described with respect to the systems shown in FIGS. 6-9. In all these systems, microcontroller 22 uses LED lifetime data estimated by a manufacturer, or uses data from a color sensor. Thus, if manufacturer's estimates show that after twenty thousand hours the Blue LED lumen output will have degraded by one percent, then after twenty thousand hours of operation, in the above-described first computation pass, the scaling factor for the Blue LED will be bolstered by one percent to compensate. In any of the examples with a color sensor, the sensor output data indicates output levels of light of each color during regular operation, which can be used as feedback for control of the LEDs, including correction for performance degradation of the LEDs that output the various light colors.

Other examples of lifetime degradation corrections will now be described by reference to systems shown in FIGS. 15-18. In each of these systems, a sensor is included to provide information about lifetime degradation in multi-color LED systems. The sensor, which may be a photodiode, is used to report degradation of the LEDs to a processor, such as microcontroller 22. The sensor replaces manufacturer's datasheet based information. The sensor, however, may only sense light level, e.g. output of one color of LEDs at a time while LEDs of other color(s) are turned OFF, instead of a sensor providing real-time feedback as to color characteristics of the combined light output of the system.

Figure 15:
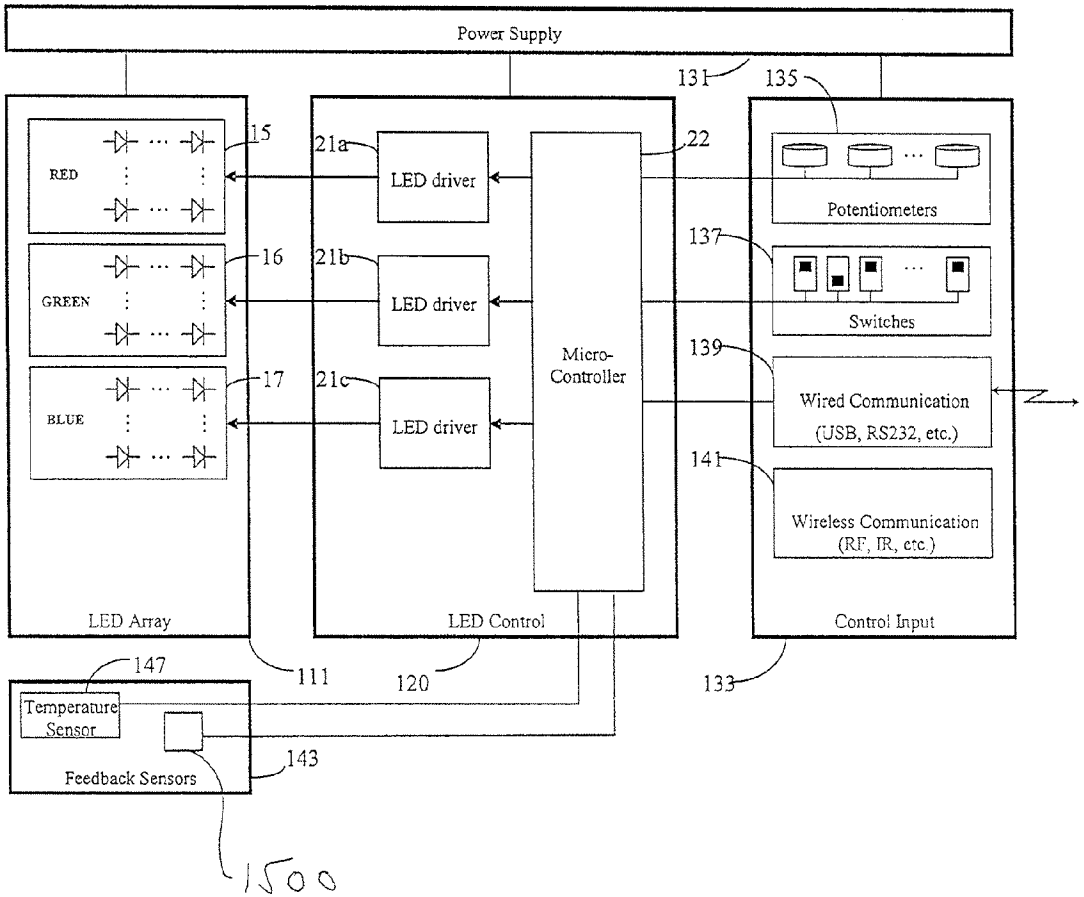
FIG. 15 is a functional block diagram of the electrical components of an example of a light emitting system using programmable digital control logic, where three channels drive three color light sources, i.e., Red LEDs, Green LEDs, and Blue LEDs, respectively; in addition, a photosensor measures levels of light from each of the three color light sources at selected intervals of time to determine operational degradations in the color light sources.

Referring now to FIG. 15, there is shown a block diagram of another example of circuitry for light sources and associated control circuit, providing digital programmable control. This circuit example has a configuration similar to the configuration of the circuit example of FIG. 6, and where appropriate, similar elements are identified by the same reference numerals. Thus, the description of the same components as those of FIG. 6 will be omitted. The feedback sensors 143 provide system performance measurements as feedback signals to the control logic, implemented in this example by microcontroller 22. In the illustrated example, the set 143 of feedback sensors includes a photodiode, generally designated as 1500. The photodiode 1500 is positioned in or around the system to measure the appropriate physical conditions of the LEDs e.g. overall intensity levels of light outputs of the LEDs.

Figure 21A:
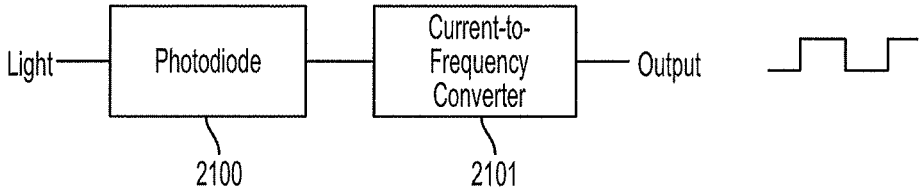
FIG. 21A is a functional block diagram of the electrical components of an example of a light-to-frequency converter, where inputted light intensity is converted to outputted frequency.
Figure 21B:
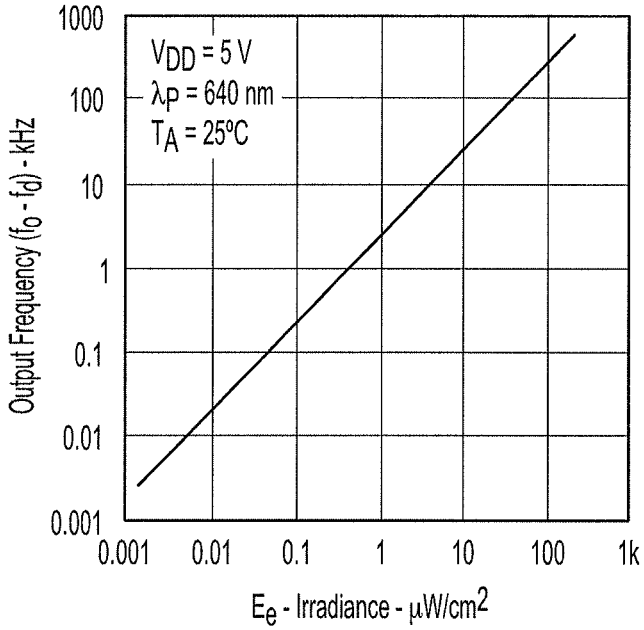
FIG. 21B illustrates an example of a characteristic of a light-to-frequency converter (i.e., output frequency vs. irradiance).

The photodiode 1500 may be a simple photodiode, such as a TSL238T high-sensitivity-light-to-frequency converter, manufactured by Texas Advanced Optoelectronic Solutions (TAOS) Inc., located in Plano, Tex. The TSL238T light-to-frequency converter combines a silicon photodiode and a current-to-frequency converter on a single monolithic CMOS integrated circuit. A functional block diagram of the TSL238T light-to-frequency converter is shown in FIG. 21A and includes a photodiode 2100 connected in series to a current-to-frequency converter 2101. An output from the TSL238T light-to-frequency converter includes a square wave (50% duty cycle) with frequency directly proportional to light intensity (irradiance) on the photodiode. A typical characteristic of the TSL238T is shown in FIG. 21B in terms of output frequency versus irradiance.

The TSL238T outputs a frequency that may be as high as 1 MHz and, thus, may be used in field calibration techniques that require high speed. For example, at 500 KHz, needed information may be obtained in a time period of 2 μsec, since T=1/F, where T is the time period and F is the frequency. Higher accuracy results may also be obtained by allowing microcontroller 22 to average the output from the TSL238T over ten cycles (for example, 20 pee). By using pulse accumulation, or integration techniques, the frequency measurements provide an added benefit of averaging out random, or high frequency jitter resulting from noise in the light signal inputted into the TSL238T.

It will be appreciated that traditional color sensors have a long response time (such as hundreds of milliseconds). If a slower field calibration is selected for the multi-color system of FIG. 15, then a color sensor may be used in lieu of the TSL238T. For example, a I2C (Inter-Integrated Circuit) based sensor has an integration time of 100 msec to 500 msec. The examples of lighting systems as shown in FIGS. 15-18, however, advantageously obtain calibration information in a short period of time and, therefore, a sensor with a short response time, such as the TSL238T, is preferable over the I2C based sensor.

Figure 19:
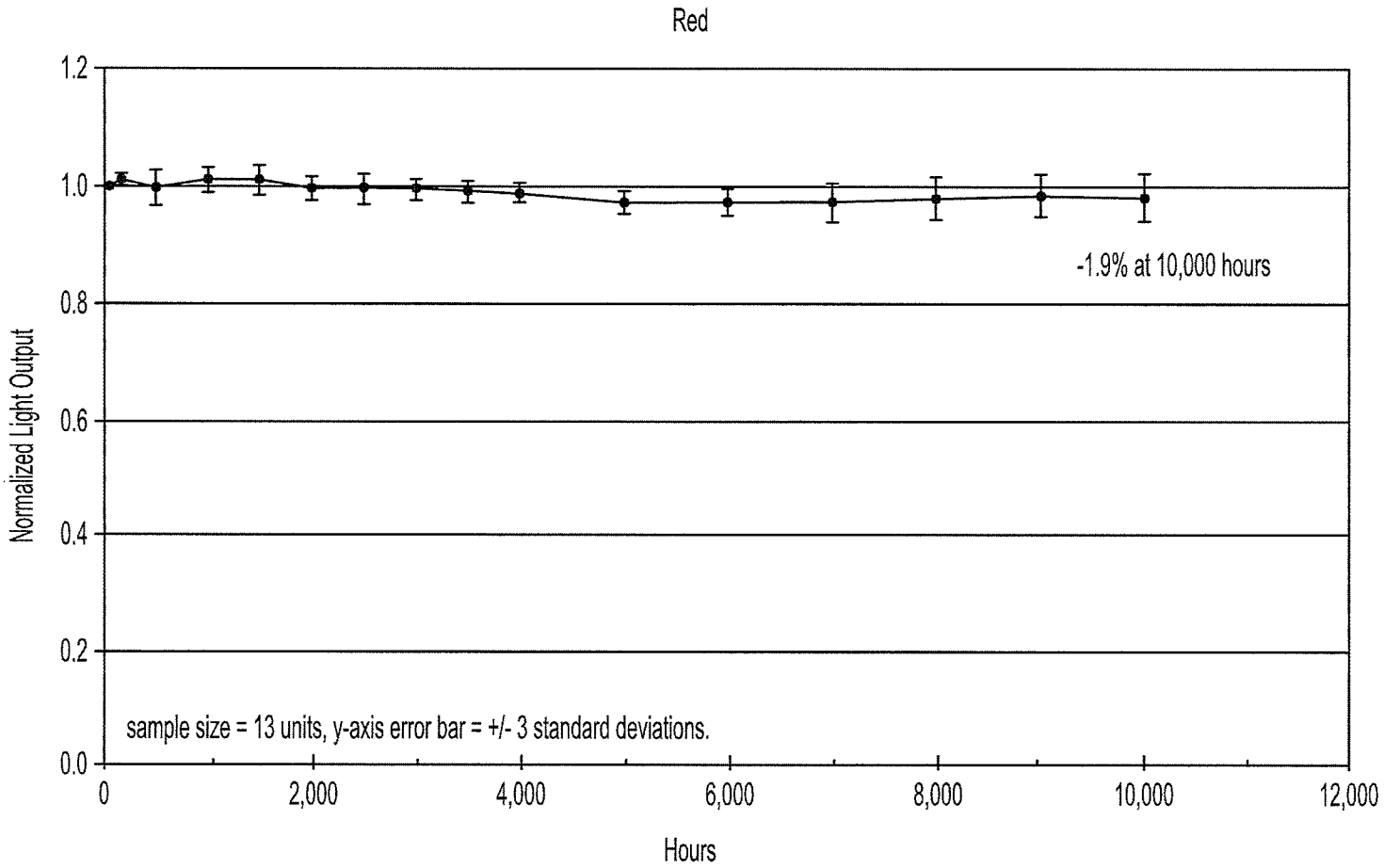
FIG. 19 illustrates an example of a Red LED's lifetime degradation characteristic (i.e., hours used vs. light output).

In operation, photodiode 1500 simply measures luminosity of the light and returns a corresponding frequency output. For example, at time t=0, the string of Red LEDs 15 may be measured by the photodiode at a frequency of 50 KHz. The measurement of Red intensity is taken while the microcontroller deactivates the drive currents to LEDs of other colors, in a manner that disables light output (Off state) from the other color LEDs of the system. Due to lifetime degradation, it is possible that at time t=10,000 hours, photodiode 1500 may return a frequency of only 49.05 KHz, due to 1.9% degradation. Such data may be predicted, for example, from the manufacturer; although the sensor will measure the actual light output reflecting degradation of the actual Red LEDs after such a period of operation. Referring now to FIG. 19, there is shown manufacturer's data of lifetime degradation of a Red LED (specifically, a LUXEON Rebel stressed at 85 degrees Centigrade). As shown, at 10,000 hours the Red LED is degraded by 1.9% compared to its luminosity at beginning of life (t=0).

Figure 20:
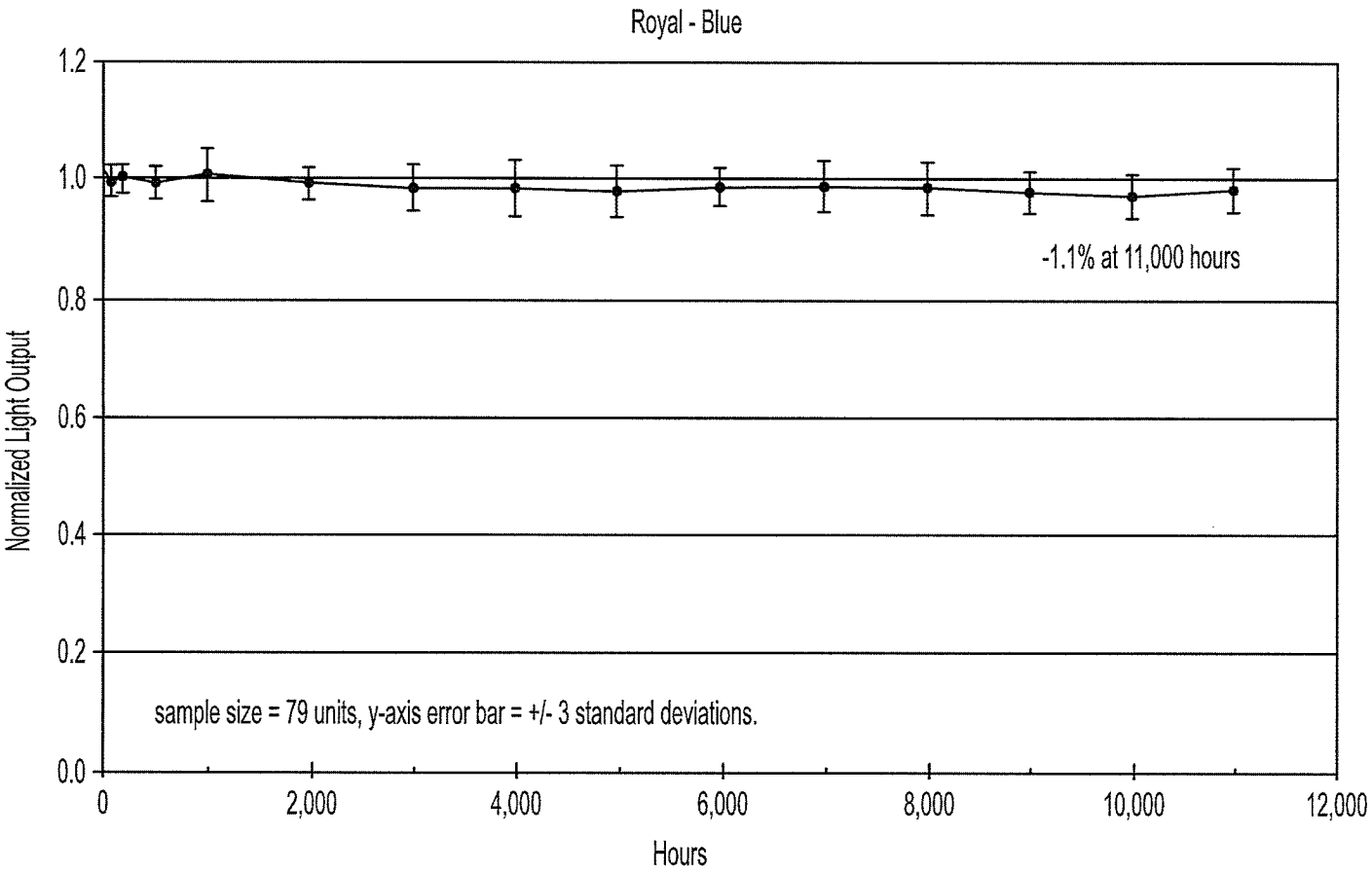
FIG. 20 illustrates another example of a Royal Blue LED's lifetime degradation characteristic (i.e., hours used vs. light output).

In addition, photodiode 1500 may measure the string of Blue LEDs 17, at time t=0, to output a luminosity equivalent of 45 KHz, while the LEDs of other colors are Off. Then, at time t=10,000 hours, due to lifetime degradation, it is possible that photodiode 1500 may return a frequency of only 44.5 KHz (while the LEDs of other colors are Off), thereby indicating an intensity loss of 1.1% in light output from the string of Blue LEDs. Again, such data may be obtained, for example, from the manufacturer; although the sensor will measure the actual light output reflecting degradation of the actual Blue LEDs after such a period of operation. Referring now to FIG. 20, there is shown manufacturer's data of lifetime degradation of a Royal Blue LED (specifically, a LUXEON Rebel stressed at 110 degrees Centigrade). As shown, at 10,000 hours the Royal Blue LED is degraded by 1.1% compared to its luminosity at beginning of life (t=0).

As may be seen from FIGS. 19 and 20, the relative degradation between the string of RED LEDs and the string of BLUE LEDs at approximately 10000 hours is a difference of about 0.8%. Thus, the effect of this degradation may be very small when compared to the overall system performance. It will be appreciated that RGB systems and tunable white systems depend on all the colors used in the system; therefore, as long as they degrade at the same rate, the target colors within the defined gamut of the system is still largely the same mix of individual colors. Accordingly, the lighting systems in the present examples provide a simple photodiode to read this degradation back to the microcontroller, and the microcontroller is programmed to make appropriate changes. In the above example, the microcontroller may push the RED driver to drive the Red LEDs by 0.8% harder than the originally set drive current. Based on this information, microcontroller 22 may be programmed to increase the string of Red LEDs by 0.8%, which is the difference in lifetime degradation between the string of Red LEDs and the string of Blue LEDs (1.9%-1.1%).

In a similar manner, the string of Green LEDs 16 may be measured to have a lifetime degradation, for example, of 1.6% at 10,000 hours of operation, while the LEDs of other colors are Off. As such, microcontroller 22 may be programmed to increase the string of Green LEDs by 0.5%, which is the relative difference in lifetime degradation between the string of Blue LEDs and the string of Green LEDs (1.6%-1.1%). In both examples, the string of LEDs that has experienced the greater degradation has its respective LED driver (21*a*-21*c*) provide a greater current drive, so that the luminosity output of the respective string of LEDs experiences the same relative level as the string possessed at time t=0.

In general, LEDs degrade with time and, after a certain amount of time, the output luminosity is less than it was at the beginning of life. If different color LEDs degrade at different rates, the resulting mixed output in an RGB system, or in a tunable white system may not be the same color anymore. In order to offset this problem, the present example uses photodiode 1500 to measure the changes in luminosity and programs the microcontroller 22 to correct for the changes in luminosity over the lifetime of a multi-colored LED system based on differences in actual measured output luminosities.

In the above examples, the microcontroller is programmed to increase the light output of each string of LEDs by a relative amount, so that only differential aging among the string of LEDs is corrected after a predetermined number of operating hours of the system. In this manner, the microcontroller maintains the relative luminosity among the strings of LEDs substantially constant over the lifetime of the system. As another option, the microcontroller may be programmed to increase the light output of each string of LEDs by an absolute amount. In this option, corrections may be performed for absolute luminosity and not only for differential aging. Thus, the drive currents of the respective strings of LEDs may be increased to levels that are similar to those measured by photodiode 1500 at time t=0. It will be appreciated, however, that corrections for relative luminosity are preferred over corrections for absolute luminosity. The corrections for relative luminosity are more conducive to maintaining a stable color balance among the strings of LEDs.

It will be appreciated that if all LEDs in the system naturally degraded at the same rate, the mixed light output would not change. The only change would be a change in total output luminosity, which may be measured and equally boosted up. However, there are different material compositions of LEDs in an RGB and tunable white system and, therefore, the LEDs degrade at different rates. Thus, one has to carefully select the changes that are made in the output of one string versus another string.

Figure 16:
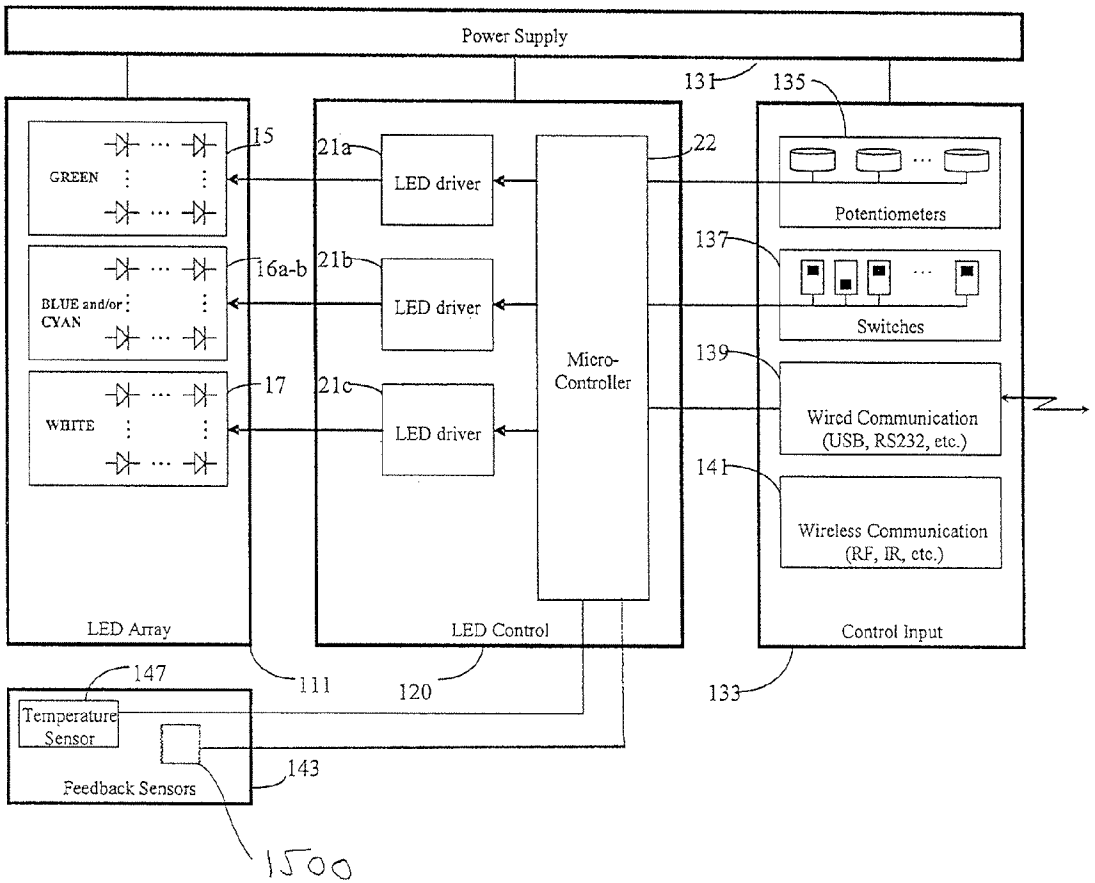
FIG. 16 is a functional block diagram of the electrical components of another example of a light emitting system using programmable digital control logic, where three channels drive three color light sources, i.e., Green LEDs, a combination of Blue and/or Cyan LEDs, and White LEDs, respectively; in addition, a photosensor measures levels of light from each of the three color light sources at selected intervals of time to determine operational degradations in the color light sources.

Referring next to FIG. 16, there is shown a block diagram of another example of circuitry for light sources and associated control circuit, providing digital programmable control. This circuit example has a configuration similar to the configuration of the circuit example of FIG. 15, and where appropriate, similar elements are identified by the same reference numerals. Thus, the description of the same components as those of FIG. 15 will be omitted. The array 111 includes at least one Green LED 15, at least one White LED 17, and at least one Blue LED and/or at least one Cyan LED in the second control channel (i.e., 16*a*-16*b*). The three driver circuits 21*a*, 21*b* and 21*c* drive three color light sources, i.e., the Green LEDs 15, the Blue/Cyan LEDs 16*a*-16*b* and the White LEDs 17, respectively.

Figure 17:
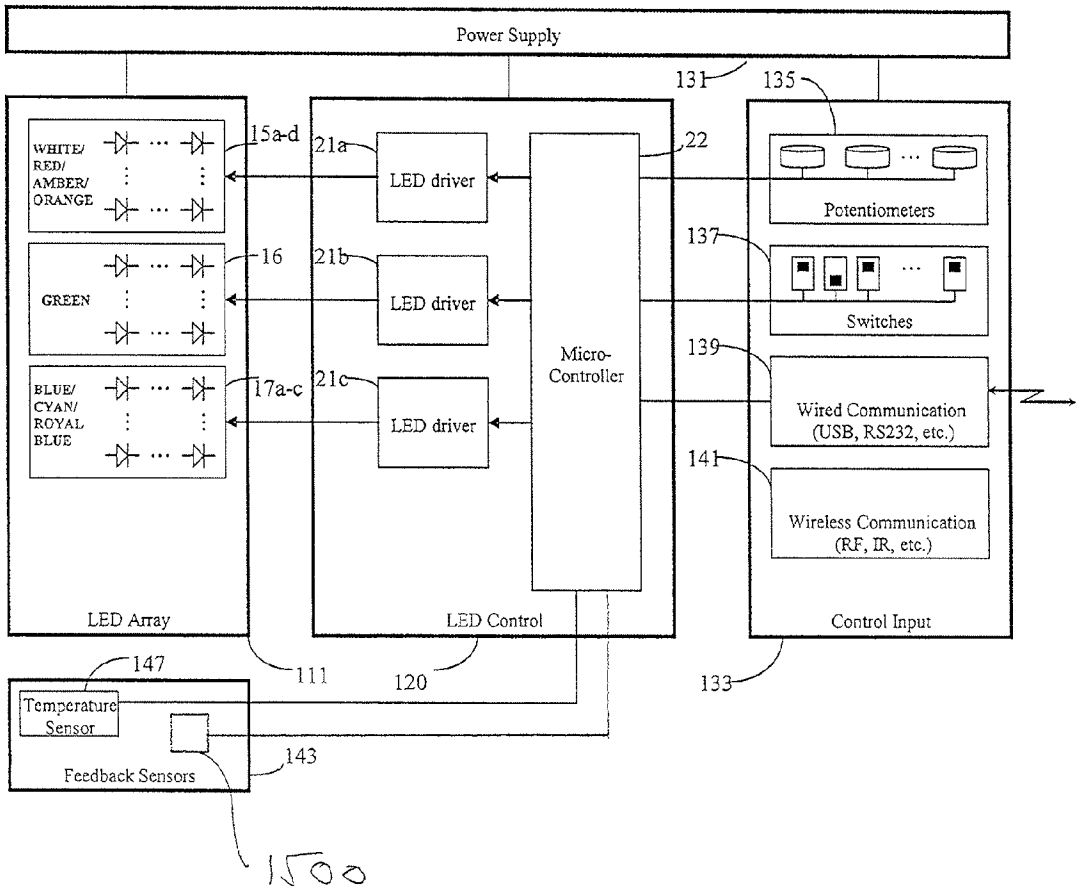
FIG. 17 is a functional block diagram of the electrical components of still another example of a light emitting system using programmable digital control logic, where three channels drive three color light sources, i.e., a combination of White, Red, Amber and Orange LEDs, Green LEDs, and a combination of Blue, Cyan and Royal Blue LEDs, respectively; in addition, a photosensor measures levels of light from each of the three color light sources at selected intervals of time to determine operational degradations in the color light sources.

FIG. 17 is a block diagram of still another example of circuitry for light sources and associated control circuit, providing digital programmable control. This circuit example has a configuration similar to the configuration of the circuit example of FIG. 15, and where appropriate, similar elements are identified by the same reference numerals. Thus, the description of the same components as those of FIG. 15 will be omitted. The array 111 includes at least one Green LED 16, at least one White LED in series with at least one Red and/or Amber and/or Orange LED (i.e., 15*a*-15*d*), and at least one Blue LED in series with at least one Cyan and/or Royal Blue LED (i.e., 17*a*-17*c*). The three driver circuits 21*a*, 21*b* and 21*c* drive four color light sources, i.e., the White LED in series with at least Red/Amber/Orange LEDs 15*a*-15*d*, the Green LEDs 16 and the Blue/Cyan/Royal Blue LEDs 17*a*-17*b*, respectively.

Figure 18:
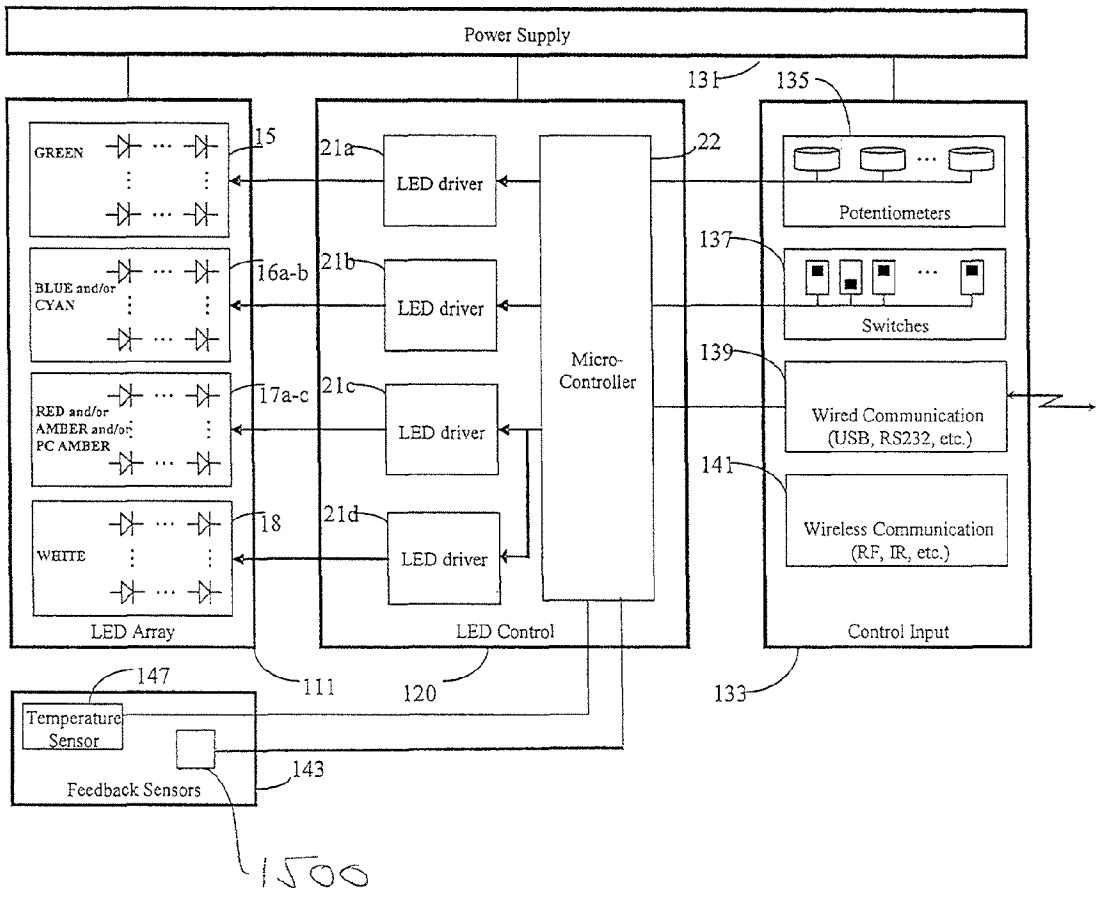
FIG. 18 is a functional block diagram of the electrical components of still another example of a light emitting system using programmable digital control logic, where four channels drive four color light sources, i.e., Green LEDs, a combination of a Blue and/or Cyan LEDs, a combination of Red and/or Amber and/or PC Amber LEDs, and White LEDs, respectively; in addition, a photosensor measures levels of light from each of the four color light sources at selected intervals of time to determine operational degradations in the color light sources.

FIG. 18 is a block diagram of still another example of circuitry for light sources and associated control circuit, providing digital programmable control. This circuit example has a configuration similar to the configuration of the circuit example of FIG. 15, and where appropriate, similar elements are identified by the same reference numerals. Thus, the description of the same components as those of FIG. 15 will be omitted. The system 120 includes driver circuits 21*a*-21*d* for the various LEDs and the microcontroller 22. The system may also include one or more digital to analog converters (DACs) (not separately shown). In this regard, the microcontroller 22 may control the DACs, which in turn provide signals to the respective drivers 21*a* to 21*d*. The analog current output level of each of the driver circuits 21*a* to 21*d* may be controlled by a higher level logic of the system. The array 111 includes at least one Green LED in the first control channel (i.e., 15), at least one Blue LED and/or at least one Cyan LED in the second control channel (i.e., 16*a*-16*b*), at least one Red LED and/or at least one Amber LED and/or at least one Phosphor-Converted (PC) Amber LED in the third control channel (i.e., 17*a*-17*c*), and at least one White LED in the fourth control channel 18. The four driver circuits 21*a*-21*d* drive four color light sources, i.e., the Green LEDs 15, the Blue/Cyan LEDs 16*a*-16*b* and the Red/Amber/PC Amber LEDs 17*a*-17*c*, and the White LEDs 18, respectively.

The microcontroller 22 receives control inputs specifying the particular 'recipe' or mixture. The input information will include or can be translated to color coordinates of a target point, for a desired color characteristic for the combined output light from the system. The input information may also indicate an overall intensity or dimming level. Then, the microcontroller 22 controls the LED driver circuits 21*a* to 21*d* accordingly, to set appropriate intensity levels for the LEDs 15 to 18 providing the light of the various colors, so that the system provides the desired color characteristic and overall intensity in the combined light output from the system. Referring to FIG. 18, the microcontroller 22 controls the four LED driver circuits 21*a*-21*d* through three logical channels (indicated by three control lines originated from the microcontroller 22 to the LED drivers 21*a*-21*c*). More particularly, the first and second logical channels are used to control the driver circuits 21*a* and 21*b*, respectively, while the third logical channel is used to commonly control the two driver circuits 21*c* and 21*d*. Thus, with this circuit configuration of FIG. 18, LED control algorithms based on three logical channels can be applied to the four color light sources 15-18. Furthermore, with an appropriate mapping between three logical channels and more than three color light sources, such control algorithms based on three logical channels can be applied to any number of color light sources, each source with any number of varieties of LEDs or other light emitters.

Similar color correction procedures can be implemented in any system having three or more channels of control of different color LED sources, such as in the four examples of FIGS. 15-18. Moreover, the disclosed systems and methods may require pre-programmed performance data. These data are used for specifying the endpoints of the output volume and establishing the relationships between the driver settings and the Tristimulus XYZ light output. The manner in which these performance data may be obtained and stored into the non-volatile memory coupled to the microcontroller 22 has been described previously with respect to the system configurations shown in FIGS. 6-9 and apply equally to the system configurations shown in FIGS. 15-18. Furthermore, the two (or more) pass approach to determine color corrected driver settings based on a target CIE 1931 input in a multi-color lighting system has been described with respect to FIGS. 6-9 and apply equally to the system configurations shown in FIGS. 15-18.

Figure 22:
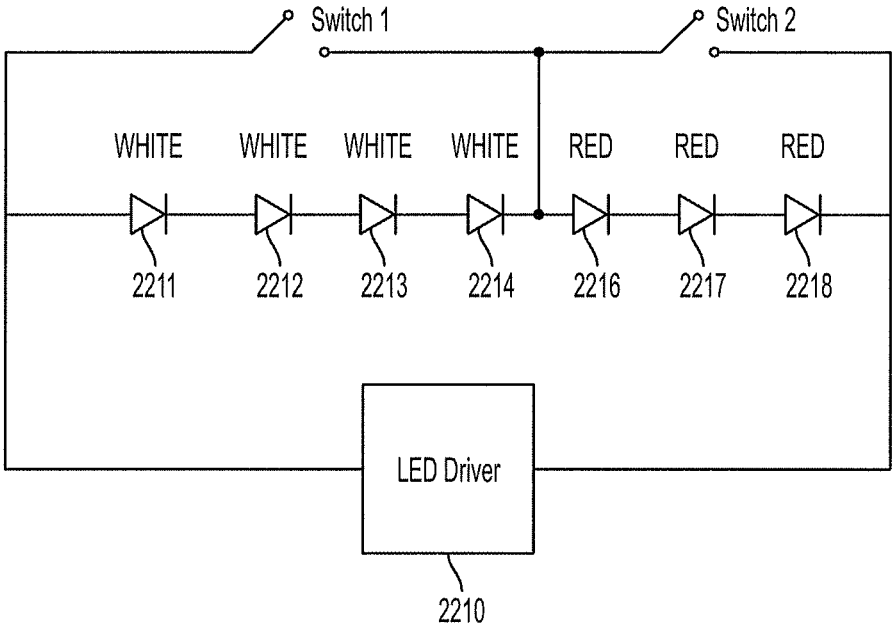
FIG. 22 illustrates an example of a single channel LED driver driving a set of White LEDs and a set of Red LEDs, where both sets are connected in series and can separately be driven, or not driven by the LED driver.

As already described, a simple photodiode may measure light output from the LED system; and by taking measurements of output from LEDs of particular colors while other color LEDs are off, the lighting system can determine current performance characteristics of different colors or control channels of the LEDs of the system. At the beginning of life of the system, the light output from each different color in each string of LEDs (connected in series, parallel, or any combination thereof) may be measured. Then after a predetermined amount of time, the light output from each different color in the string of LEDs may be measured again. If this light output has changed, appropriate changes may be made to the drive currents for that string of LEDs. Attention is now directed to FIG. 22, which shows a string of LEDs that includes two different colors of LEDs. As an example, a first set of four White LEDs, designated as 2211 through 2214, is serially connected to a second set of three Red LEDs, designated as 2216 through 2218. Both LED colors are driven by the same LED driver, designated as 2210. For example, in normal operation, one driver controls the current applied to all LEDs 2216 through 2218, in common.

The present example, nevertheless, may measure the light output of two different colored strings, although they are connected in series. This may be accomplished by turning a portion of the string OFF during such measurement, and measuring the output of the other portion. Thus, in the example shown in FIG. 22, switch 1 (which may be controlled by way of microcontroller 22) may be used to turn OFF the string of white LEDs and then photodiode 1500 may measure the light output of the string of Red LEDs. Similarly, switch 2 (which may be controlled by way of microcontroller 22) may be used to turn OFF the string of Red LEDs and then photodiode 1500 may measure the light output of the string of White LEDs. This procedure is important in systems like those shown in FIGS. 16-18, which have serial strings of mixed colors, such as the Blue/Cyan LEDs 16*a*-*b* shown in FIG. 16; the White/Red/Amber/Orange LEDs 15*a*-*d* shown in FIG. 17; or the Red/Amber/PC Amber LEDs 17*a*-*c* shown in FIG. 18. Of course, if more than two different colors of LEDs are serially connected in one string, then more than two switches are provided to shut OFF each of the colors, for example, three switches are used for three colors of LEDs connected in series.

There are several methods of initiating a field calibration for measuring the changes in the luminosity of LEDs in an RGB system, or a tunable white system. Three examples are as follows:

(1) Manual push button trigger: This method allows the operator to perform calibration based on a schedule. Since lifetime degradation is a slow phenomenon, the method may be triggered in intervals of several weeks, or months, or after a year or more.

(2) Manual through software/network trigger: This method is similar to the Manual push button method, but instead of a physical button, the method may be triggered remotely from a lighting network.

(3) Automatic trigger: This method is similar to the Manual push button method, except calibration may be triggered automatically by the firmware, or software in the processor or controller of the system, for example, after the passage of a programmed time interval or after some specified number of hours or operation. A suitable set of lighting conditions may need to be determined, such as the time of day, or the appropriate environmental settings, so that proper calibration may be performed at different periods of time.

The calibration methods described above all use a photodiode, such as that shown in FIGS. 15-18. A simple differential correction (or an absolute correction) may be initiated, as described. The calibration and correction may be executed by the processor, or controller in the system, in addition to any other algorithms running within the system. For example, as described with respect to the methods of FIGS. 10 through 14, the first pass scaling factors may be increased by an amount to compensate for LED lifetime degradation, as shown in step S1410 of FIG. 14. This step defines three endpoints in a triangle corresponding to the boosted intensity of color characteristics in a first color space, as performed by step S1110 of FIG. 11A. For example, the three endpoints of the triangle may be as shown in FIG. 11B. The other steps may also be performed to sequentially close-in on a desired spectral characteristic resulting from a selected 'dimming of light' by the user.

Figure 23:
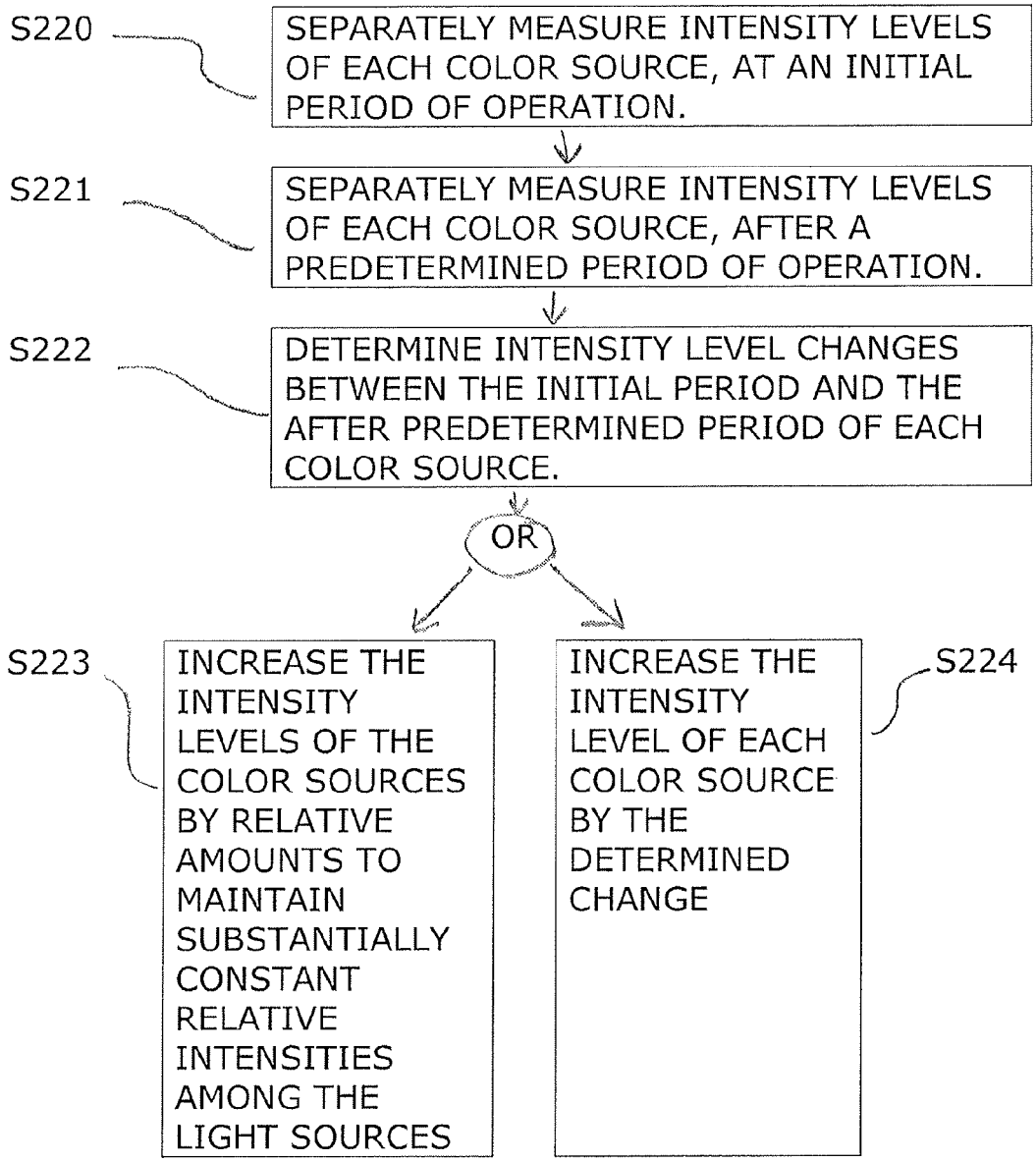
FIG. 23 is a flow chart, illustrating an example of a lifetime degradation determination, which is added to the color correction methods.

FIG. 23 is a flow chart, which illustrates an example of a lifetime degradation determination. As shown, the method includes several steps, which may be executed by microcontroller 22. In a first step (S220), the method measures the intensity levels of each color source in the system during an initial period of operation. It will be appreciated that the initial period of operation may occur at the manufacturer's location, or at the user's location. It will also be understood that these initial measurements may be skipped, if manufacturer's data is available on the initial intensity levels of each of the color sources. This data, whether determined by the method or obtained from the manufacturer, may be stored in memory for use by microcontroller 22.

After a predetermined period of operation, for example, 10,000 hours of operation, or other trigger event initiated by a remote terminal or a local user, the method may separately measure the intensity levels of each color source (S221). In order to measure the intensity levels of each color source, it is contemplated in the example that microcontroller 22 may turn ON the photosensor for measuring the intensity levels of each color source. Each color source (one or more LEDs producing the same color) is measured at a time, while the other color sources are turned OFF. After completion of the measurements, the photosensor may be turned OFF by the microcontroller.

Having measured the intensity levels of each color source at the initial period of operation, and the intensity level of the same color source at the after-predetermined period of operation, the method determines the intensity level changes in each color source between these two different periods (S222).

In the example shown in FIG. 23, the method then provides two options for increasing the intensity levels of the color sources, which have been degraded due to lifetime aging, namely, a relative intensity increase option (S223), or an absolute intensity increase option (S224). In the relative intensity increase option, the method determines the relative amount of change in each of the color sources and increases the drive current to each of the respective color sources, so that the relative intensity levels, among the color sources, are maintained at substantially constant output levels. In the absolute intensity increase option, the method increases the intensity level of each color source by the amount of change determined in step S222. It will be appreciated, as described above, that the relative intensity increase option is better than the absolute intensity increase option.

The microcontroller 22 may implement the aforementioned changes due to lifetime degradation using two options. A first option may apply the changes directly to the DACs controlling the LED drivers, which are connected to the multiple strings of LEDs. In this option, the lifetime correction may be separated from the general algorithms described with respect to FIG. 14. A second option may be to allow the general algorithms to increase the intensity levels as implemented by the method depicted in FIG. 14.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A method for controlling a multi-color lighting system for combining light from multiple solid state light sources of the system, each configured for producing light of a different color characteristic, each light source comprising one or more light emitting diodes (LEDs), the method comprising the steps of:

for a period of operation, selectively controlling drive currents supplied to the LEDs of the multiple solid state light sources to produce a combined light output of overall color characteristic and intensity corresponding to a user input selection based in part on determined output characteristics of the LEDs of the multiple solid state light sources;

after the period of operation, obtaining updated output characteristics of the LEDs of the multiple solid state light sources by:

driving one or more LEDs configured for producing light of a first color characteristic, while LEDs configured for producing light of different color characteristics than the first color characteristic are turned OFF, and measuring a level of the light of the first color characteristic with a photosensor;

driving one or more LEDs configured for producing light of a second color characteristic, while LEDs configured for producing light of different color characteristics than the second color characteristic are turned OFF, and measuring a level of the light of the second color characteristic with the photosensor;

driving one or more LEDs configured for producing light of a third color characteristic, while LEDs configured for producing light of different color characteristics than the third color characteristic are turned OFF, and measuring a level of the light of the third color characteristic with the photosensor; and processing the measured levels of the light of the first, second and third color characteristics to obtain updated output characteristics of the LEDs of the multiple solid state light sources; and selectively controlling drive currents supplied to the LEDs of the multiple solid state light sources to produce combined light output of an overall color characteristic corresponding to a user input selection, based in part on the updated determined output characteristics of the LEDs of the multiple solid state light sources, wherein the step of selectively controlling the drive currents based in part on the updated determined output characteristics includes:

correcting changes in performance of the LEDs of the multiple solid state light sources, after the period of operation of the multi-color lighting system.

2. The method of claim 1 wherein the step of correcting changes in performance includes:

correcting changes in performance due to a lifetime degradation of the LEDs of the multiple solid state light sources.

3. The method of claim 1 wherein the step of processing includes:

determining a relative amount of change in each of the three levels of light, after the period of operation, in which the relative amount of change is measured between (a) an initial time during the period of operation and (b) a final time after the period of operation; and determining the smallest relative amount of change among the first, second and third color characteristics; and the step of selectively controlling the drive currents based in part on the updated determined output characteristics includes:

increasing the drive current supplied to the one or more LEDs configured for producing a respective first, second, or third color characteristic by the difference between (a) the smallest relative amount of change and (b) the relative amount of change determined in the respective first, second, or third color characteristic.

4. The method of claim 1 wherein the step of processing includes:

determining each of the three levels of light, at an initial time during the period of operation; and determining a respective amount of change for each of the three levels of light, at a final time after the period of operation; and the step of selectively controlling the drive currents based in part on the updated determined output characteristics includes:

increasing the drive current supplied to the one or more LEDs configured for producing a respective first, second, or third color characteristic by the respective amount of change.

5. The method of claim 1 including the steps of:

driving one or more LEDs configured for producing light of a fourth color characteristic, while LEDs configured for producing light of different color characteristics than the fourth color characteristic are turned OFF, and measuring a level of the light of the fourth color characteristic with the photosensor; and processing the measured level of the light of the fourth color characteristic to obtain updated output characteristics of the LEDs of the multiple solid state light sources.

6. The method of claim 5 wherein the processing includes:

determining a relative amount of change in each of the four levels of light, after the period of operation, in which the relative amount of change is measured between (a) an initial time during the period of operation and (b) a final time after the period of operation; and determining the smallest relative amount of change among the first, second, third and fourth color characteristics; and the step of selectively controlling drive currents based in part on the updated determined output characteristics includes:

increasing the drive current supplied to the one or more LEDs configured for producing a respective first, second, third, or fourth color characteristic by the difference between (a) the smallest relative amount of change and (b) the relative amount of change determined in the respective first, second, third, or fourth color characteristic.

7. The method of claim 5 wherein the processing includes:

determining each of the four levels of light, at an initial time during the period of operation; and determining a respective amount of change for each of the four levels of light, at a final time after the period of operation; and the step of selectively controlling drive currents based in part on the updated determined output characteristics includes:

increasing the drive current supplied to the one or more LEDs configured for producing a respective first, second, third, or fourth color characteristic by the respective amount of change.

8. The method of claim 1, wherein a first set of multiple LEDs and a second set of multiple LEDs are connected in series for producing, respectively, the light of the first and second color characteristics, the method including the steps of:

driving the first set of LEDs configured for producing light of the first color characteristic, while the second set of LEDs is electrically shorted, and measuring the level of the light of the first color characteristic with the photosensor; and driving the second set of LEDs configured for producing light of the second color characteristic, while the first set of LEDs is electrically shorted, and measuring the level of the light of the second color characteristic with the photosensor.

9. A lighting system comprising:

at least three light sources each for producing light of a different one of at least three colors, each light source including one or more light emitting diodes (LEDs);

an input;

a photosensor; and a controller responsive to information received via the input and coupled to control the at least three light sources to produce a combined light output of the system, wherein the controller is configured to control functions of the lighting system, including functions to:

for a period of operation of the lighting system, selectively control drive currents supplied to the LEDs of the at least three light sources to produce combined light output of an overall color characteristic corresponding to a user input selection, based in part on determined output characteristics of the LEDs of the at least three light sources;

after the period of operation of the lighting system, obtain updated output characteristics of the LEDs of the at least three light sources by functions to:

drive one or more LEDs configured for producing light of a first of the at least three color characteristics, while LEDs configured for producing light other than the first color characteristic are turned OFF, and measure a level of the light of the first color characteristic with the photosensor;

drive one or more LEDs configured for producing light of a second of the at least three color characteristics, while LEDs configured for producing light other than the second color characteristic are turned OFF, and measure a level of the light of the second color characteristic with the photosensor;

drive one or more LEDs configured for producing light of a third of the at least three color characteristics, while LEDs configured for producing light other than the third color characteristic are turned OFF, and measure a level of the light of the third color characteristic with the photosensor; and process the measured levels of the light of the first, second and third color characteristics to obtain the updated output characteristics of the LEDs of the at least three light sources;

selectively control drive currents supplied to the LEDs of the three light sources to produce a combined light output of an overall color characteristic corresponding to a user input selection, based in part on the updated output characteristics of the LEDs of the three light sources;

determine a relative amount of change in each of the three levels of light, after the period of operation, in which the relative amount of change is measured between (a) an initial time during the period of operation and (b) a final time after the period of operation;

determine the smallest relative amount of change among the first, second, and third color characteristics; and increase the drive current supplied to the one or more LEDs configured for producing a respective first, second, or third color characteristic by the difference between (a) the smallest relative amount of change and (b) the relative amount of change determined in the respective first, second, or third color characteristic.

10. A lighting system comprising:

at least three light sources each for producing light of a different one of at least three colors, each light source including one or more light emitting diodes (LEDs);

an input;

a photosensor; and a controller responsive to information received via the input and coupled to control the at least three light sources to produce a combined light output of the system, wherein the controller is configured to control functions of the lighting system, including functions to:

for a period of operation of the lighting system, selectively control drive currents supplied to the LEDs of the at least three light sources to produce combined light output of an overall color characteristic corresponding to a user input selection, based in part on determined output characteristics of the LEDs of the at least three light sources;

after the period of operation of the lighting system, obtain updated output characteristics of the LEDs of the at least three light sources by functions to:

drive one or more LEDs configured for producing light of a first of the at least three color characteristics, while LEDs configured for producing light other than the first color characteristic are turned OFF, and measure a level of the light of the first color characteristic with the photosensor;

drive one or more LEDs configured for producing light of a second of the at least three color characteristics, while LEDs configured for producing light other than the second color characteristic are turned OFF, and measure a level of the light of the second color characteristic with the photosensor;

drive one or more LEDs configured for producing light of a third of the at least three color characteristics, while LEDs configured for producing light other than the third color characteristic are turned OFF, and measure a level of the light of the third color characteristic with the photosensor; and process the measured levels of the light of the first, second and third color characteristics to obtain the updated output characteristics of the LEDs of the at least three light sources;

selectively control drive currents supplied to the LEDs of the three light sources to produce a combined light output of an overall color characteristic corresponding to a user input selection, based in part on the updated output characteristics of the LEDs of the three light sources;

determine each of the three levels of light, at an initial time during the period of operation;

determine a respective amount of change for each of the three levels of light, at a final time after the period of operation; and increasing the drive current supplied to the one or more LEDs configured for producing a respective first, second, or third color characteristic by the respective amount of change.

11. The lighting system of claim 9 wherein:

the photosensor is configured to provide a frequency value to the controller; and the frequency value indicates a sensed level of light.

12. The lighting system of claim 9 including:

a first set of multiple LEDs forming a first of the light sources and a second set of multiple LEDs forming a second of the light sources connected in series for producing, respectively, the light of the first and second color characteristics, and a first switch for electrically shorting the first set of multiple LEDs and a second switch for electrically shorting the second set of multiple LEDs;

wherein the controller is configured to drive the first set of LEDs, while the second set of LEDs is electrically shorted, and measure the level of the light of the first color characteristic with the photosensor; and the controller is configured to drive the second set of LEDs, while the first set of LEDs is electrically shorted, and measure the level of the light of the second color characteristic with the photosensor.

13. The lighting system of claim 9 wherein the controller is configured to control further functions of the lighting system, including functions to:

turn OFF the photosensor, during the period of operation; and turn ON the photosensor, after the period of operation, for measuring the levels of the light with the photosensor.

14. The lighting system of claim 9 wherein information received at the input includes one of the following:

a manual command to turn ON the photosensor; and an automatic command from a remote location to turn ON the photosensor.

15. The lighting system of claim 9 wherein the controller is configured to provide the following functions on receiving an input from a user relating to color coordinates of a target point defined in a color space:

determine first-pass driver currents supplied to the LEDs for the three light sources to achieve spectral characteristics of light at the target point; and determine second-pass driver currents supplied to the LEDs for the three light sources to achieve spectral characteristics of light at the target point;

wherein the second-pass driver currents are configured to be closer to the target point than the first-pass driver currents.

16. The lighting system of claim 10 wherein:

the photosensor is configured to provide a frequency value to the controller; and the frequency value indicates a sensed level of light.

17. The lighting system of claim 10 including:

a first set of multiple LEDs forming a first of the light sources and a second set of multiple LEDs forming a second of the light sources connected in series for producing, respectively, the light of the first and second color characteristics, and a first switch for electrically shorting the first set of multiple LEDs and a second switch for electrically shorting the second set of multiple LEDs;

wherein the controller is configured to drive the first set of LEDs, while the second set of LEDs is electrically shorted, and measure the level of the light of the first color characteristic with the photosensor; and the controller is configured to drive the second set of LEDs, while the first set of LEDs is electrically shorted, and measure the level of the light of the second color characteristic with the photosensor.

18. The lighting system of claim 10 wherein the controller is configured to control further functions of the lighting system, including functions to:

turn OFF the photosensor, during the period of operation; and turn ON the photosensor, after the period of operation, for measuring the levels of the light with the photosensor.

19. The lighting system of claim 10 wherein information received at the input includes one of the following:

a manual command to turn ON the photosensor; and an automatic command from a remote location to turn ON the photosensor.

20. The lighting system of claim 10 wherein the controller is configured to provide the following functions on receiving an input from a user relating to color coordinates of a target point defined in a color space:

determine first-pass driver currents supplied to the LEDs for the three light sources to achieve spectral characteristics of light at the target point; and determine second-pass driver currents supplied to the LEDs for the three light sources to achieve spectral characteristics of light at the target point;

wherein the second-pass driver currents are configured to be closer to the target point than the first-pass driver currents.

* * * * *